US005948579A

United States Patent [19]

Mashimo et al.

[11] Patent Number: 5,948,579

[45] **Date of Patent: *Sep. 7, 1999**

[54] ELECTROPHOTOGRAPHIC PHOTOSENSITIVE MATERIAL

[75] Inventors: Kiyokazu Mashimo; Toru Ishii; Katsumi Nukada; Masahiro Iwasaki; Taketoshi Higashi; Fumio Ojima, all of Minami-Ashigara, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/743,001

[22] Filed: Nov. 1, 1996

[30] Foreign Application Priority Data

Nov. 6, 1995 [JP] Japan ..... 7-287159

[51] Int. Cl.[6] ..... G03G 5/047

[52] U.S. Cl. ..... 430/59; 430/96

[58] Field of Search ..... 430/96, 59

[56] References Cited

U.S. PATENT DOCUMENTS

| | | | |
|---|---|---|---|
| 4,599,286 | 7/1986 | Limburg et al. | 430/59 |
| 4,801,517 | 1/1989 | Frechet et al. . | |
| 4,806,443 | 2/1989 | Yanus et al. . | |
| 4,806,444 | 2/1989 | Yanus et al. . | |
| 4,888,262 | 12/1989 | Tamaki et al. | 430/59 |
| 4,931,372 | 6/1990 | Takei et al. | 430/69 |
| 4,937,165 | 6/1990 | Ong et al. . | |
| 4,959,288 | 9/1990 | Ong et al. . | |
| 4,983,482 | 1/1991 | Ong et al. . | |
| 5,034,296 | 7/1991 | Ong et al. . | |
| 5,286,588 | 2/1994 | Suzuki | 430/59 |
| 5,310,613 | 5/1994 | Pai et al. | 430/59 |
| 5,604,064 | 2/1997 | Nukada et al. | 430/96 |
| 5,618,646 | 4/1997 | Nogami et al. | 430/59 |
| 5,702,856 | 12/1997 | Mashimo et al. | 430/96 |

FOREIGN PATENT DOCUMENTS

| | | |
|---|---|---|
| 53-87226 | 8/1978 | Japan . |
| 59-28903 | 7/1984 | Japan . |
| 61-20953 | 1/1986 | Japan . |
| 1-134456 | 5/1989 | Japan . |
| 1-134457 | 5/1989 | Japan . |
| 4-133065 | 5/1992 | Japan . |
| 4-133066 | 5/1992 | Japan . |
| 6-21416 | 1/1994 | Japan . |

OTHER PUBLICATIONS

Diamond, Arthur S. Handbook of Imaging Materials. New York: Marcel–Dekker, Inc., pp. 436–439, 1991.

Borsenberger, Paul M. & David S. Weiss. Organic Photoreceptors for Imaging Systems. New York: marcel–Dekker, Inc., pp. 393–405 1993.

*Primary Examiner*—Christopher D. Rodee

*Attorney, Agent, or Firm*—Oliff & Berridge, PLC

[57] ABSTRACT

An improved electrophotographic photosensitive material having a photosensitive layer on a conductive support. The photosensitive layer comprises a charge transporting polymeric compound having at least one structure represented by the following general formula (I-1) or (I-2) as a partial structure of a repeating unit, and at least one compound having a hindered phenol structural unit represented by the following general formula (II) or a hindered amine structural unit represented by the following general formula (III):

(I-1)

(I-2)

(II)

(III)

20 Claims, 4 Drawing Sheets

ELECTROPHOTOGRAPHIC PHOTOSENSITIVE MATERIAL

BACKGROUND OF THE INVENTION

1. Field of the Invention

The present invention relates to electrophotographic photosensitive materials, more particularly to electrophotographic photosensitive materials exhibiting both excellent electric properties and mechanical strength for a prolonged period of time.

2. Description of Related Art

Recently, electrophotographic techniques have been significantly applied to the field of copying machines, laser beam printers and facsimiles because they provide the advantages of yielding high print qualities at high speeds. Materials for electrophotographic photosensitive materials which have widely used in the electrophotographic techniques include known inorganic photoconductive materials such as selenium, selenium-tellurium alloys, selenium-arsenic alloys and cadmium sulfide.

On the other hand, electrophotographic photosensitive materials comprising organic photoconductive materials have also actively been studied since they have excellent advantages in cost, producibility and disposability as compared with the known electrophotographic photosensitive materials using inorganic photoconductive materials. In particular, separatedly functional organic laminated photosensitive materials comprising a charge-generating layer which generates charge upon exposure and a charge-transporting layer laminated thereon are excellent in their electrophotographic properties such as sensitivity, chargeability and its repeating stability. Various proposals have been made on these materials and many of them have actually been put to practical use. On the other hand, single layer organic photosensitive materials have advantages such as high productivity, low production cost and those associated with positive charging (i.e., reduced generation of ozone, uniform chargeability); at present, however, their electrical performance is poorer than the laminated photosensitive materials. Thus, there is still plenty of room for research and development.

In these organic photosensitive materials, the above mentioned electrophotographic properties have been developed to sufficient levels of performance; however, durability to mechanical external forces is poor since they are composed of organic materials. For example, the image quality may be deteriorated by wear of and/or wounds on the photosensitive material surface generated due to direct load from toners, developers, papers and cleaning members and from recent rollers which are brought to directly contact with photosensitive materials to charge up, as well as by adhesion of foreign matters such as toner filming onto the surface. Under high humidity environment, blurring of images may be caused by deterioration of the surface layer due to ozone and/or nitrogen oxides generated by corona discharge and/or to paper dust from copy paper which is adhered to and accumulated on the surface of photosensitive materials. These problems determine the lifetime of photosensitive materials.

Upon digitization of copying machines or printers, the sensitivity of photosensitive materials should be maximized in the wavelength range (780 to 830 nm) of a near infrared semiconductor laser so as to be exposed to a semiconductor laser. Further, a cycle of process, i.e., charging, exposure, development, transfer, cleaning and charge removal, tends to be effected in a still shorter period of time as coloration, acceleration and miniaturization are advanced. Therefore, there is a need for faster light responsibility and longer electrical stability. Thus, higher durability is required in view of complication of processes and higher stress on the photosensitive material as well.

At present, charge transporting polymeric compounds have actively studied since they may obviate the above mentioned deficiencies to a large extent and can possibly meet the above mentioned requirements. For instance, U.S. Pat. No. 4,806,443 discloses polycarbonates polymerized from specific dihydroxyarylamines and bischloroformate. U.S. Pat. No. 4,806,444 discloses polycarbonates polymerized from specific dihydroxyarylamines and phosgene. U.S. Pat. No. 4,801,517 discloses polycarbonates polymerized from bishydroxyalkylarylamines and bischloroformate or phosgene. U.S. Pat. No. 4,937,165 and U.S. Pat. No. 4,959,288 disclose polycarbonates polymerized from specific dihydroxyarylamines or bishydroxyalkylarylamines, and polyesters polymerized from bisacylhalides, respectively. U.S. Pat. No. 5,034,296 discloses polycarbonates or polyesters of arylamines having a specific fluorene skeleton. U.S. Pat. No. 4,983,482 discloses specific polyurethanes. Further, Japanese Patent Application Publications (JP-B) No. 59-28903 and Japanese Patent Application Laid-Opens (JP-A) No. 53-87226 disclose polyesters having a specific bisstyryl bisarylamine as a main chain. Japanese Patent Application Laid-Opens (JP-A) No. 61-20953, No. 1-134456, No. 1-134457, No. 4-133065 and No. 4-133066 propose polymers having a charge transporting pendant substituent such as hydrazone or triarylamine and photosensitive materials using the same.

Further, Japanese Patent Application Laid-Open (JP-A) No. 6-21416 proposes photosensitive materials in which an antioxidant is added to a charge transporting polymeric compound for the purpose of improving reactive gas resistance and repeating stability as well as mechanical strength.

Although electrophotographic photosensitive materials having a relatively good durability may be obtained by using the above mentioned, previously proposed charge transporting polymeric compounds as photosensitive layers, they are still unsatisfactory in the following: Coatings formed from these charge transporting polymeric compounds do not necessarily have sufficient mechanical strength, such that when used repeatedly in a copying machine for a long period of time, the surface of a photosensitive material wears and therefore the film thickness of the photosensitive material changes, the charging voltage reduces and the sensitivity varies; as a result, a copy may be fogged or the copy density may be reduced. The image quality may deteriorate due to wear and wounds on the photosensitive material surface.

In the proposed combination with an antioxidant, the image quality may be deteriorated by discharging products such as ozone generated upon charging. Further, electrical properties are not always sufficient in the case in which the combination is applied to a high speed electrophotographic device having a small diameter drum.

SUMMARY OF THE INVENTION

To overcome these problems, the present inventors have eagerly studied materials for photosensitive layers and found that photosensitive materials with a specific combination of materials bring improvement on repeating electrical properties and image quality as well as wear resistance and mechanical strength when applied to not only conventional non-contact charging processes but also even contact charging processes. Thus, the present invention has been completed.

Accordingly, the present invention provides an electrophotographic photosensitive material having a photosensitive layer on an electroconductive support, said photosensitive layer comprising a charge transporting polymeric compound having at least one structure represented by the following general formula (I-1) or (I-2) as a partial structure of a repeating unit:

(I-1)

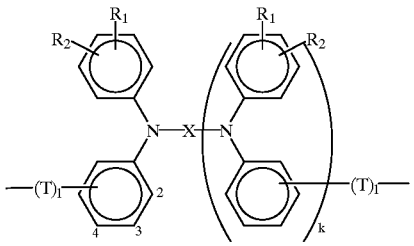

(I-1)

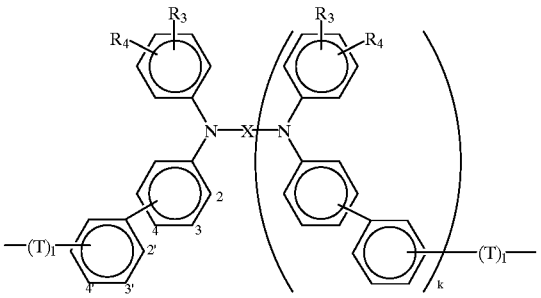

wherein $R_1$ to $R_4$ each independently represents a hydrogen atom, an alkyl group, an alkoxy group, a substituted amino group, a halogen atom, or a substituted or unsubstituted aryl group, X represents a substituted or unsubstituted divalent aryl group, k and l each independently represents an integer selected from 0 and 1 and T represents an optionally branched, divalent hydrocarbon group having 1 to 10 carbon atoms, and said photosensitive layer further comprising at least one of compounds having a hindered phenol structure unit represented by the following general formula (II) and a hindered amine structure unit represented by the following general formula (III):

(II)

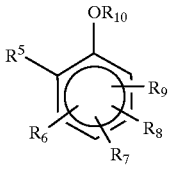

(III)

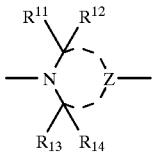

wherein $R_5$ represents a branched alkyl, $R_6$ to $R_8$ each independently represents a hydrogen atom, a hydroxy group, an alkyl group or an aryl group, at least two of $R_6$, $R_7$ and $R_8$ may be linked to one another to form a ring, $R_9$ represents a single bond, a hydrogen atom, an alkyl or an alkylene group, $R_{10}$ to $R_{14}$ each independently represents a hydrogen atom, an alkyl group or an aryl group, Z represents an atomic group required to constitute a nitrogen atom containing ring, and in each combination of $R_{11}$ and $R_{12}$ or $R_{13}$ and $R_{14}$ one of them may be combined within Z to provide a double bond, provided that one or more of $R_5$ to $R_9$ may be an aralkyl group and the remainder may be hydrogen atoms.

In the electrophotographic photosensitive materials of the present invention, mechanical strength is improved and image quality is not deteriorated for a long period of time by combining a specific charge transporting polymeric compound with a compound having a specific hindered phenol or hindered amine structural unit. It is believed that not only the respective properties of the former and latter compounds (e.g., antioxidant activity of the latter) but also their compatibility or affinity synergistically contribute to said functions and effects.

DESCRIPTION OF THE PREFERRED EMBODIMENTS

Figure 1:
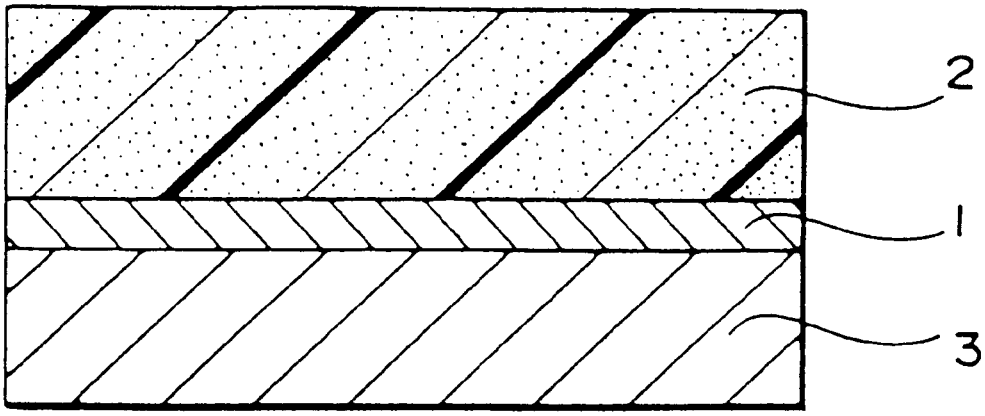
FIG. 1 is a schematic cross section of an example of the electrophotographic photosensitive material according to the present invention.

The present invention will hereinafter be described in more detail.

In the chemical structure represented by the formula (I-1) or (I-2) as a partial structure of the charge transporting polymeric compound used in the present invention, $R_1$ to $R_4$ each independently represents a hydrogen atom, an alkyl group, an alkoxy group, a substituted amino group, a halogen atom or a substituted or unsubstituted aryl group as described above. Preferably, $R_1$ to $R_4$ are alkyl having 1 to 40 carbon atoms, said alkyl group optionally having one or more substituents selected from any of an aryl group, an alkoxy group, an acid group, an amide group and a halogen atom.

Specific examples of X in the aforementioned general formula (I-1) or (I-2) are the groups (1)–(7).

(1)

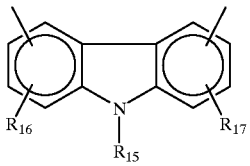

-continued (2)

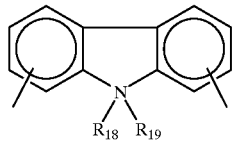

(3)

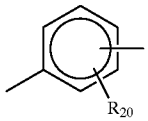

(4)

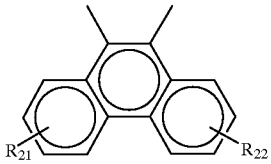

(5)

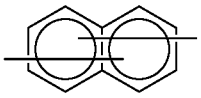

(6)

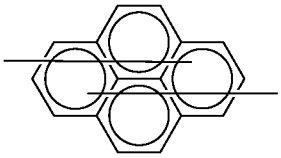

(7)

—Ar—$(V)_a$—Ar— where $R_5$ is selected from the group consisting of a hydrogen atom, an alkyl group of 1–4 carbon atoms, a substituted or unsubstituted phenyl group and a substituted or unsubstituted araklyl group, $R_6$–$R_{12}$ are each independently selected from the group consisting of a hydrogen atom, an alkyl group of 1–4 carbon atoms, an alkoxy group of 1–4 carbon atoms, a substituted or unsubstituted phenyl group, a substituted or unsubstituted araklyl group and a halogen atom, Ar respresents the following group (8), V is selected from the group consisting of the following groups (9)–(18) and a is 0 or 1.

(8)

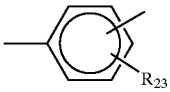

where $R_{23}$ is selected from the group consisting of hydrogen, an alkyl group of 1–4 carbon atoms, an alkoxy group of 1–4 carbon atoms, a substituted or unsubstituted phenyl group, a substituted or unsubstituted araklyl group and a halogen atom, (9)

$-(CH_2)_b-$

-continued (10)

$-C(CH_3)_2-$ (11)

—O—

(12)

—S—

(13)

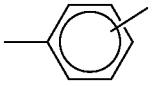

(14)

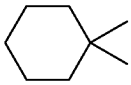

(15)

$-C(CF_3)_2-$ (16)

$-Si(CF_3)_2-$ (17)

—CH═CH—

(18)

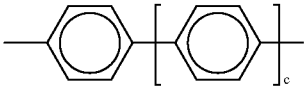

where b is an integer of 1–10 and c is an integer of 1–4.

Among the above-described polymeric compounds, particularly the polymers in which X has a biphenyl structure that is represented by the following structural formula (VI) or (VII), have a high mobility and practicability as reported in "The Sixth International Congress on Advances in Non-impact Printing Technologies. 306, 1990".

(VII)

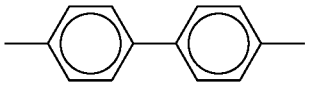

(VIII)

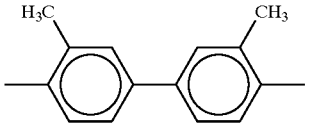

In the aforementioned general formula (I-1) or (I-2), T represents, as described hereinbefore, a divalent hydrocarbon group of 1–10 carbon atoms that may be branched. Specific structural examples thereof are given below. In these structures, for example, T-2r means the structure which has the tetra-aryl benzidine skeleton linked to the right side of T-2 structure and T-2l means the structure which has the tetra-aryl benzidine skeleton linked to the left side of T-2 (see Tables 1–6).

(T-1)

$-CH_2-$ (T-2)

$-(CH_2)_2-$

-continued
(T-3)
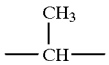
(T-4)
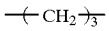
(T-5)
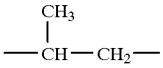
(T-6)
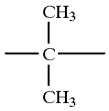
(T-7)
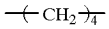
(T-8)
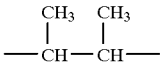
(T-9)
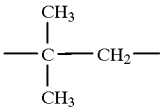
(T-10)
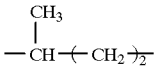
(T-11)
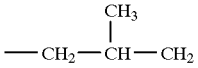
(T-12)
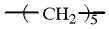
(T-13)
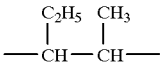
(T-14)
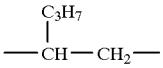
(T-15)
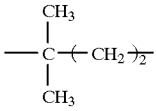
(T-16)
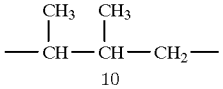
(T-17)
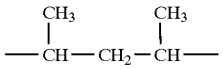
(T-18)
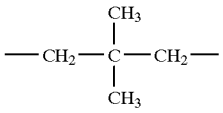
-continued
(T-19)
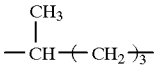
(T-20)
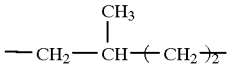
(T-21)
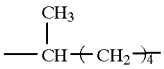
(T-22)
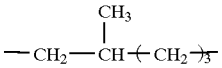
(T-23)
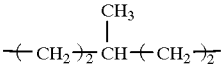
(T-24)
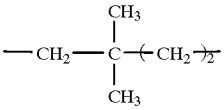
(T-25)
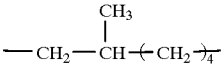
(T-26)
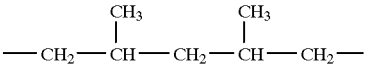
(T-27)
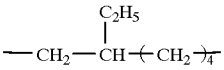
(T-28)
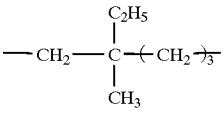
(T-29)
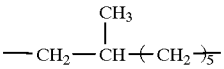
(T-30)
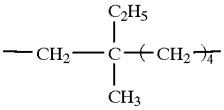
(T-31)
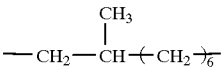
(T-32)
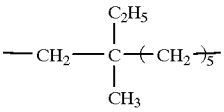
(T-33)
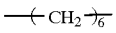

In the present invention, preferably used, as the aforementioned electric charge transporting polymeric compounds, are the compounds represented by at least one of the general formulas (IV)–(VI):

(IV)

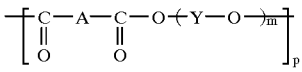

(V)

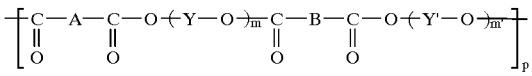

(VI)

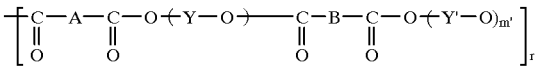

where A represents the structure indicated by the aforementioned general formula (I-1) or (I-2), Y, Y' and B are each a divalent hydrocarbon group, m and m' are each an integer of 1–5, p is an integer of 5–5,000, q is an integer of 5–5,000, r is an integer of 1–3,500 and the sum of q+r is an integer of 5–5,000 with the provision that $1>q/(q+r)\geqq 0.3$. Y and Y' are preferably selected from the following groups (19)–(25):

(19)

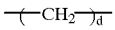

(20)

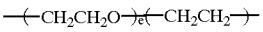

(21)

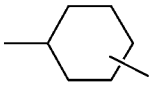

(22)

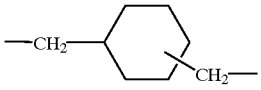

(23)

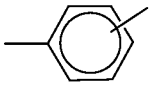

(24)

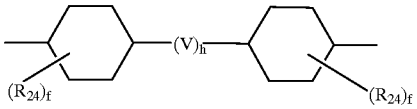

(25)

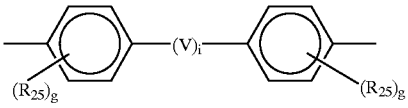

where $R_{24}$ and $R_{25}$ are selected from the group consisting of hydrogen, an alkyl group of 1–4 carbon atoms, an alkoxy group of 1–4 carbon atoms, a substituted or unsubstituted phenyl group, a substituted or unsubstituted aralkyl group and a halogen atom, d and e are each an integer of 1–10, f and g are each an integer of 0, 1 or 2, and h and i are each an integer of 0 or 1. V is the same as the aforementioned one.

B is preferably an alkylene group of 1–10 carbon atoms, an o-, m- or p-phenylene group, a naphthalene group or a biphenylene group.

Given below are specific examples of the above-mentioned electric charge transporting polymeric compounds. Tables 1–3 shows examples of the structure represented by the general formula (I-1), Tables 4–6 show examples of the structure represented by the general formula (I-2), Tables 7 and 8 show examples of the structure represented by the general formula (IV), Table 9 shows examples of the structure represented by the general formula (V) and Table 10 shows examples of the structure represented by the general formula (VI).

Illustrative examples of the compounds represented by the general formula (I-1)

TABLE 1

| CN | X | $R_1$ | $R_2$ | PB | k | T |
|---|---|---|---|---|---|---|
| 1 | 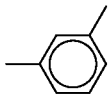 | H | H | 3 | 0 | T-2 |
| 2 | 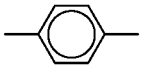 | H | H | 3 | 0 | T-2 |
| 3 | 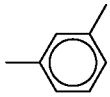 | 3-Me | 4-Me | 3 | 0 | T-2 |
| 4 | 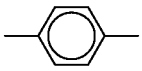 | 3-Me | 4-Me | 4 | 0 | T-2 |
| 5 | 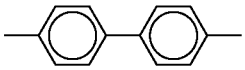 | H | H | 3 | 1 | — |
| 6 | " | H | H | 3 | 1 | T-2 |
| 7 | " | H | H | 3 | 1 | T-51 |
| 8 | " | H | 4-Me | 3 | 1 | T-2 |
| 9 | " | H | 4-Ph | 3 | 1 | T-2 |
| 10 | " | 3-Me | 4-Me | 3 | 1 | T-81 |
| 11 | " | 3-Me | 4-Me | 3 | 1 | T-251 |
| 12 | " | H | H | 4 | 1 | T-5r |
| 13 | " | H | H | 4 | 1 | T-1 |
| 14 | " | H | H | 4 | 1 | T-2 |

CN: Compound number
PB: Position for bonding (which are the same as in all the tables.)
": ditto TABLE 2
| CN | X | $R_1$ | $R_2$ | PB | k | T |
|---|---|---|---|---|---|---|
| 15 | 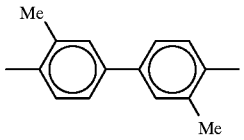 | 3-Me | 4-Me | 3 | 1 | — |
| 16 | " | H | H | 3 | 1 | T-2 |
| 17 | " | H | 4-Me | 3 | 1 | T-2 |
| 18 | " | 3-Me | 4-Me | 4 | 1 | T-1 |
| 19 | " | 3-Me | 4-Me | 4 | 1 | T-2 |
| 20 | " | 3-Me | 4-Me | 4 | 1 | T-4 |
| 21 | " | 3-Me | 5-Me | 4 | 1 | T-2 |
| 22 | " | 3-Me | 4-Me | 4 | 1 | T-51 |
| 23 | " | 4-Me | H | 4 | 1 | T-131 |
| 24 | 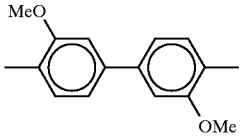 | H | H | 3 | 1 | — |
| 25 | " | H | H | 3 | 1 | T-2 |
| 26 | " | H | 4-Me | 3 | 1 | T-2 |
| 27 | " | H | 4-Ph | 3 | 1 | T-2 |
| 28 | " | 3-Me | 4-Me | 3 | 1 | T-81 |
TABLE 3
| CN | | $R_1$ | $R_2$ | PB | k | T |
|---|---|---|---|---|---|---|
| 29 | 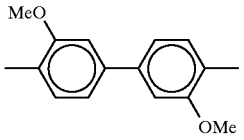 | 3-Me | 4-Me | 3 | 1 | T-251 |
| 30 | " | H | H | 4 | 1 | T-5r |
| 31 | " | 3-Me | 4-Me | 4 | 1 | T-2 |
| 32 | " | 4-Me | H | 4 | 1 | T-171 |
| 33 | 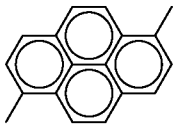 | H | H | 3 | 1 | T-2 |
| 34 | " | H | 4-Me | 3 | 1 | T-81 |
| 35 | " | 3-Me | 4-Me | 3 | 1 | T-181 |
| 36 | " | H | H | 4 | 1 | T-201 |
| 37 | " | 4-Me | H | 4 | 1 | T-241 |
| 38 | 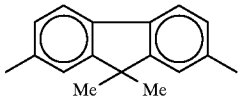 | H | H | 3 | 1 | T-2 |
| 39 | " | H | 4-Me | 3 | 1 | T-81 |
| 40 | " | 3-Me | 4-Me | 3 | 1 | T-181 |
| 41 | " | H | H | 4 | 1 | T-201 |
| 42 | " | 4-Me | H | 4 | 1 | T-241 |

TABLE 4
Examples of the compounds represented by the general formula (I-2)
| CN | X | $R_3$ | $R_4$ | PB | k | T |
|---|---|---|---|---|---|---|
| 43 | 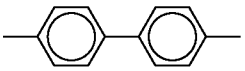 | H | H | 4, 4' | 0 | T-1 |
| 44 | " | H | H | 4, 4' | 0 | T-2 |
| 45 | " | 3-Me | 4-Me | 4, 4' | 0 | — |
| 46 | " | 3-Me | 4-Me | 4, 4' | 0 | T-2 |
| 47 | " | H | H | 4, 4' | 1 | T-1 |
| 48 | " | H | H | 4, 4' | 1 | T-2 |
| 49 | " | H | H | 4, 4' | 1 | T-51 |
| 50 | " | H | 4-Me | 4, 4' | 1 | T-2 |
| 51 | " | H | 4-Ph | 4, 4' | 1 | T-2 |
| 52 | " | 3-Me | 4-Me | 4, 4' | 1 | T-81 |
| 53 | " | 3-Me | 4-Me | 4, 4' | 1 | T-251 |
| 54 | " | H | H | 4, 4' | 1 | T-5r |
| 55 | " | 3-Me | 4-Me | 4, 4' | 1 | T-1 |
| 56 | " | 4-Me | H | 4, 4' | 1 | T-2 |
TABLE 5
| CN | X | $R_3$ | $R_4$ | PB | k | T |
|---|---|---|---|---|---|---|
| 57 | 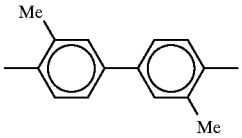 | H | H | 4, 4' | 1 | — |
| 58 | " | H | H | 4, 4' | 1 | T-2 |
| 59 | " | H | 4-Me | 4, 4' | 1 | T-2 |
| 60 | " | H | 4-Ph | 4, 4' | 1 | T-1 |
| 61 | " | 3-Me | 4-Me | 4, 4' | 1 | T-2 |
| 62 | " | 3-Me | 4-Me | 4, 4' | 1 | T-4 |
| 63 | " | H | H | 4, 4' | 1 | T-5r |
| 64 | " | 3-Me | 4-Me | 4, 4' | 1 | T-51 |
| 65 | " | 4-Me | H | 4, 4' | 1 | T-131 |
| 66 | 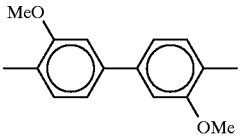 | H | H | 4, 4' | 1 | — |
| 67 | " | H | H | 4, 4' | 1 | T-2 |
| 68 | " | H | 4-Me | 4, 4' | 1 | T-2 |
| 69 | " | H | 4-Ph | 4, 4' | 1 | T-2 |
| 70 | " | 3-Me | 4-Me | 4, 4' | 1 | T-81 |
TABLE 6
| CN | X | $R_3$ | $R_4$ | PB | k | T |
|---|---|---|---|---|---|---|
| 71 | 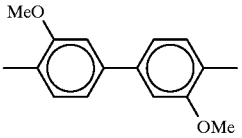 | 3-Me | 4-Me | 4, 4' | 1 | T-251 |
| 72 | " | H | H | 4, 4' | 1 | T-5r |
| 73 | " | 3-Me | 4-Me | 4, 4' | 1 | T-2 |
| 74 | " | 4-Me | H | 4, 4' | 1 | T-171 |

TABLE 6-continued

| CN | X | $R_3$ | $R_4$ | PB | k | T |
|---|---|---|---|---|---|---|
| 75 | 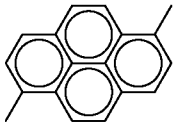 | H | H | 4, 4' | 1 | T-2 |
| 76 | " | H | 4-Me | 4, 4' | 1 | T-81 |
| 77 | " | 3-Me | 4-Me | 4, 4' | 1 | T-181 |
| 78 | " | H | H | 4, 4' | 1 | T-201 |
| 79 | " | 4-Me | H | 4, 4' | 1 | T-241 |
| 80 | 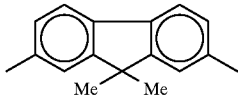 | H | H | 4, 4' | 1 | T-2 |
| 81 | " | H | 4-Me | 4, 4' | 1 | T-81 |
| 82 | " | 3-Me | 4-Me | 4, 4' | 1 | T-181 |
| 83 | " | H | H | 4, 4' | 1 | T-201 |
| 84 | " | 4-Me | H | 4, 4' | 1 | T-241 |

TABLE 7

Examples of compounds represented by the general formula (IV)

| CN | Partial constitution constitution | Partial constitution Ratio | Y | m | p |
|---|---|---|---|---|---|
| 85 | 6 | — | —$CH_2CH_2$— | 1 | 165 |
| 86 | 6 | — | " | 2 | 55 |
| 87 | 6 | — | 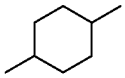 — | 1 | 35 |
| 88 | 6 | — | 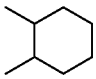 — | 1 | 40 |
| 89 | 6 | — | 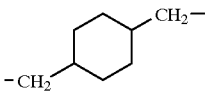 — | 1 | 30 |
| 90 | 3 | — | —$CH_2CH_2$— | 1 | 230 |
| 91 | 19 | — | " | 1 | 165 |
| 92 | 21 | — | " | 1 | 150 |
| 93 | 26 | — | " | 1 | 200 |
| 94 | 33 | — | " | 2 | 60 |
| 95 | 39 | — | " | 1 | 145 |

TABLE 8

| CN | Partial constitution consti-tution | Partial constitution Ratio | Y | m | p |
|---|---|---|---|---|---|
| 97 | 46 | — | —$CH_2CH_2$— | 1 | 210 |
| 98 | 47 | — | " | 2 | 140 |
| 99 | 48 | — | " | 1 | 150 |
| 100 | 61 | — | " | 1 | 175 |
| 101 | 68 | — | " | 1 | 175 |
| 102 | 73 | — | " | 1 | 180 |
| 103 | 6/19 | 1/1 | " | 1 | 200 |
| 104 | 6/48 | 1/1 | " | 1 | 170 |
| 105 | 22/47 | 1/1 | " | 1 | 160 |
| 106 | 22/48 | 1/1 | " | 2 | 155 |
| 107 | 22/75 | 1/1 | " | 1 | 180 |

TABLE 9

Examples of compounds represented by the general formula (V)

| CN | Partial constitution constitution | Partial constitution Ratio | Y, Y' | B | m, m' | p |
|---|---|---|---|---|---|---|
| 108 | 6 | — | —$CH_2CH_2$— | 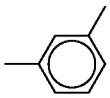 — | 1 | 20 |
| 109 | 6 | — | " | 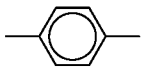 " | 1 | 15 |
| 110 | 19 | — | " | " | 1 | 35 |
| 112 | 19 | — | " | —$CH_2CH_2$— | 1 | 45 |
| 113 | 19 | — | 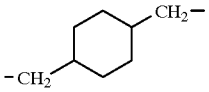 — | 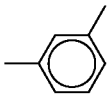 — | 1 | 20 |
| 114 | 48 | — | —$CH_2CH_2$— | " | 1 | 15 |

TABLE 10

Examples of compounds represented by the general formula (VI)

| CN | Partial constitution constitution | Partial constitution Ratio | Y, Y' | m, m' | B | q | r |
|---|---|---|---|---|---|---|---|
| 122 | 6 | — | —$CH_2CH_2$— | 1 | —$(CH_2)_4$— | 140 | 35 |
| 123 | 6 | — | " | 2 | —$(CH_2)_4$— | 115 | 15 |
| 124 | 6 | — | " | 1 | —$(CH_2)_8$— | 150 | 30 |
| 125 | 19 | — | " | 1 | —$(CH_2)_8$— | 90 | 60 |
| 126 | 19 | — | " | 1 | 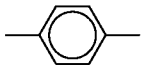 " | 110 | 70 |
| 127 | 19/21 | 1/1 | " | 1 | —$(CH_2)_8$— | 110 | 40 |
| 128 | 17 | — | " | 1 | —$(CH_2)_4$— | 85 | 85 |
| 129 | 17 | — | " | 2 | —$(CH_2)_4$— | 45 | 45 |
| 130 | 17 | — | " | 1 | —$(CH_2)_8$— | 80 | 40 |
| 131 | 38 | — | —$CH_2CH_2CH_2$— | 1 | 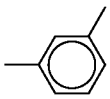 — | 60 | 30 |
| 132 | 47 | — | —$CH_2CH_2$— | 1 | —$(CH_2)_4$— | 130 | 30 |
| 133 | 47 | — | " | 1 | —$(CH_2)_{10}$— | 130 | 10 |
| 134 | 48 | — | " | 1 | —$(CH_2)_4$— | 115 | 50 |
| 135 | 48 | — | " | 1 | —$(CH_2)_6$— | 120 | 30 |
| 136 | 75 | — | " | 3 | —$(CH_2)_8$— | 60 | 20 |
| 137 | 19/47 | 1/1 | " | 1 | —$(CH_2)_8$— | 80 | 40 |
| 138 | 21/48 | 1/1 | —$CH_2CH_2CH_2$— | 1 | —$(CH_2)_8$— | 80 | 60 |
| 139 | 21/61 | 1/1 | —$CH_2CH_2$— | 1 | —$(CH_2)_6$— | 110 | 40 |

Hereinafter, the compounds having a hindered phenol structural unit represented by the following general formula (II) (hindered phenol compounds) and the compounds having a hindered amine structural unit represented by the following general formula (III) (hindered amine compounds) will be described.

In the above described general formula (II) representing the hindered phenol structural unit, $R_5$ represents a branched alkyl group, $R_6$ to $R_8$ each represents a hydrogen atom, a hydroxy group, an alkyl group or an aryl group, at least two of $R_6$, $R_7$ and $R_8$ may be linked to one another to form a ring, $R_9$ represents a single bond, a hydrogen atom, an alkyl group or an alkylene group, and $R_{10}$ is a hydrogen atom, an alkyl group or an aryl group, provided that one or more of $R_5$ to $R_9$ may be an aralkyl group and the others may be hydrogens, as mentioned above.

Preferably, $R_5$ is a tert- or sec-alkyl group having 3 to 40 carbon atoms, more preferably 3 to 5 carbon atoms. $R_6$ to $R_8$ are an alkyl group preferably having 1 to 40 carbon atoms or an aryl group such as a phenyl group, a naphthyl group or a pyridyl group. When $R_6$ and $R_7$ form a ring, a chroman ring is preferred. Preferably, the alkyl or alkylene group represented by $R_9$ has preferably 1 to 20 carbon atoms. Preferably, $R_{10}$ is a hydrogen atom or an alkylene group.

Since what is required for the hindered phenol compounds used in the present invention is that they have the above described structural unit, they include those consisting of the structural unit per se and those containing other chemical structures, i.e., those wherein $R_9$ is a single bond to which other chemical structure is bonded. In the latter, any chemical structure may be bonded so far as the advantageous effects of the present invention may be provided. Examples thereof may include hydrocarbons which may comprise a carbonyl group, a carboxy group, phosphate ester, an oxygen atom, a nitrogen atom or a sulphur atom. Specific examples thereof may include an alkyl group, an aryl group, an aralkyl group; a thioalkyl group, a thioaryl group, a thioaralkyl group; an alkyl-, aryl- or aralkyl-substituted amino group; and any cyclic groups, each of which may further contain a carbonyl group, a carboxy group, phosphate ester, an oxygen atom, a nitrogen atom or a sulphur atom.

In the above described general formula (III) representing the hindered amine structural unit, $R_{11}$ to $R_{14}$ each independently represents a hydrogen atom, an alkyl group or an aryl group, Z represents an atomic group required to constitute a nitrogen atom containing ring, as mentioned above. In any of the combinations of $R_{11}$ and $R_{12}$ or $R_{13}$ and $R_{14}$, one of them may be incorporated into Z to provide a double bond.

Preferably, Z is an atomic group constituting a 5- or 6-membered ring. Preferred ring structures may include piperidine, piperazine, morpholine, pyrrolidine, imidaziline, oxazolidine, thiazolidine, selenazolidine, pyrroline, imidazoline, isoindoline, tetrahydroisoquinoline, tetrahydropyridine, dihydropyridine, dihydroisoquinoline, oxazoline, thiazoline, selenazoline, and pyrrole.

Since what is required for the hindered amine compounds used in the present invention is that they have the above described structural unit, the valences of the nitrogen atom and Z which do not constitute the ring may be occupied by any atoms or groups so far as the advantageous effects of the present invention may be provided. Examples thereof bonded to the nitrogen atom may include a hydrogen atom, an alkyl group, an aryl group, an aralkyl group and any cyclic groups, each of which may contain a carbonyl group, a carboxy group, an oxygen atom, a nitrogen atom or a sulphur atom. Examples of groups bonded to Z may include a hydrogen atom, an alkyl group, an aryl group, an aralkyl group; a thioalkyl group, a thioaryl group, a thioaralkyl group; an alkyl-, aryl- or aralkyl substituted amino group; and any cyclic groups, each of which may contain a carbonyl group, a carboxy group, an oxygent atom, a nitrogern atom or a sulphur atom.

Illustrative examples of the compounds having the hindered phenol structural unit (II) or hindered amine structural unit (III) will be given below.

(II-1)

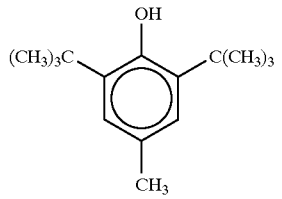

(II-2)

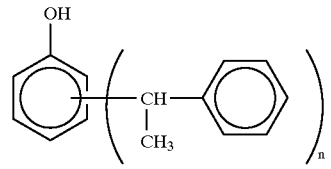

(II-3)

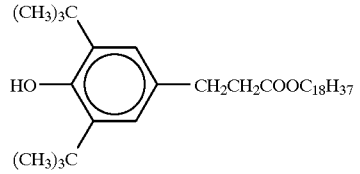

-continued
(II-4)
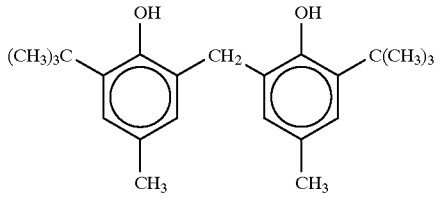
(II-5)
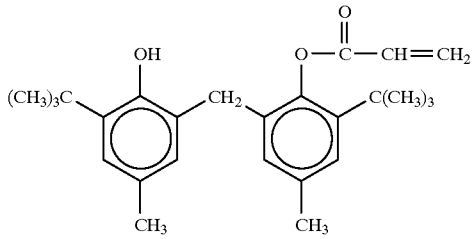
(II-6)
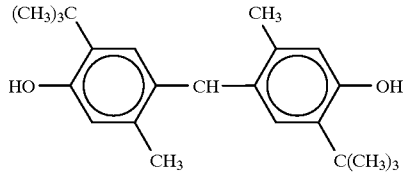
(II-7)
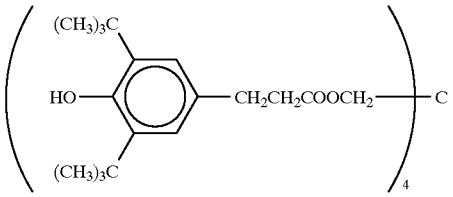
(II-8)
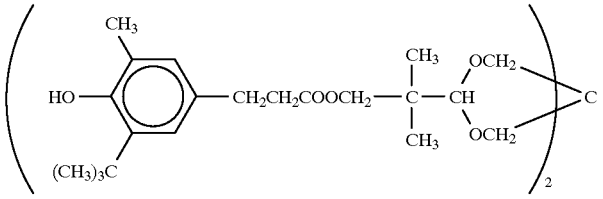
(II-9)
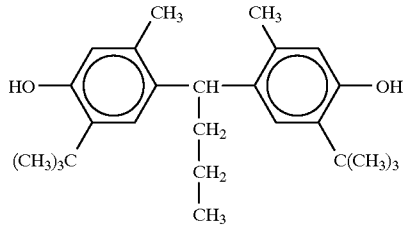

-continued
(II-10)
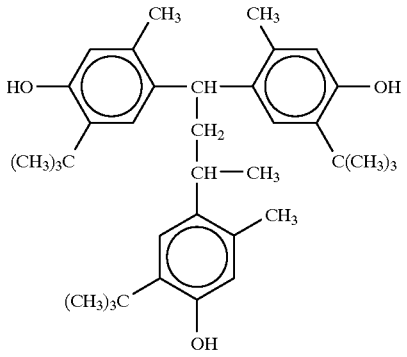
(II-11)
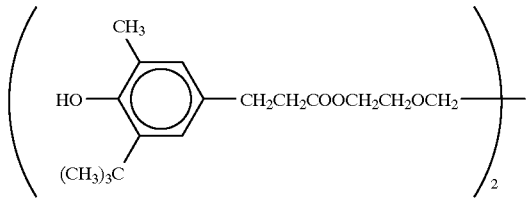
(II-12)
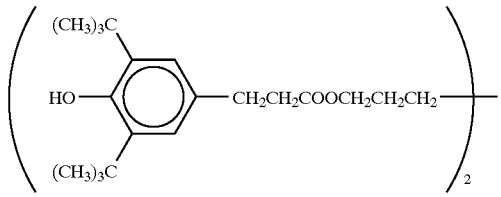
(II-13)
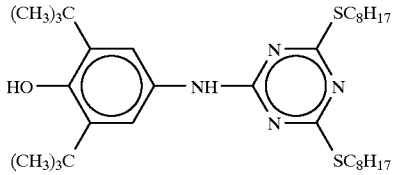
(II-14)
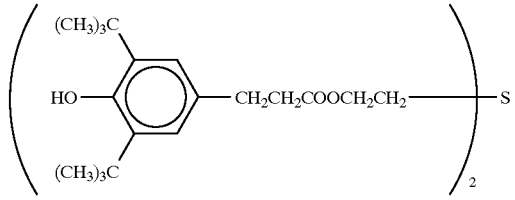
(II-15)
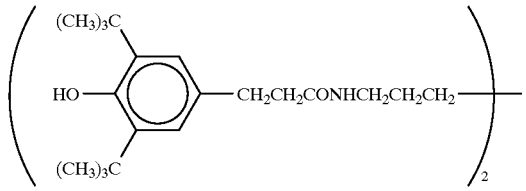
(II-16)
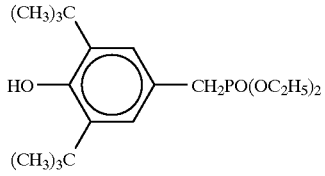

-continued
(II-17)
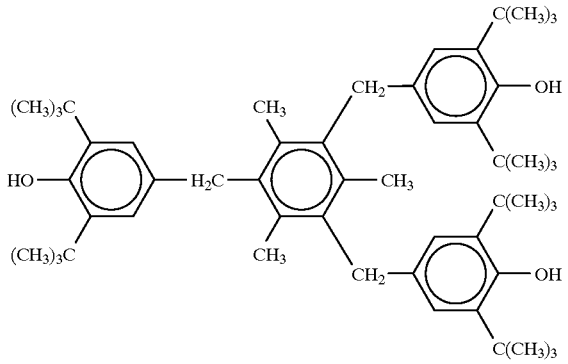
(II-18)
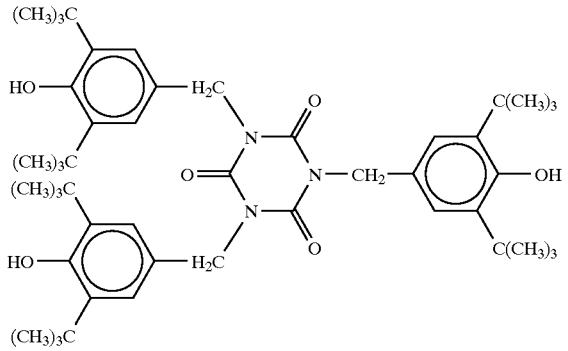
(II-19)
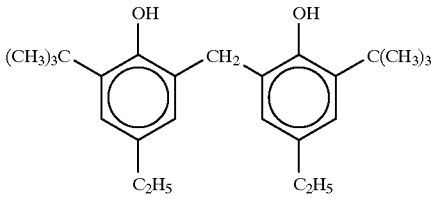
(II-20)
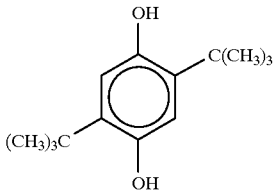
(II-21)
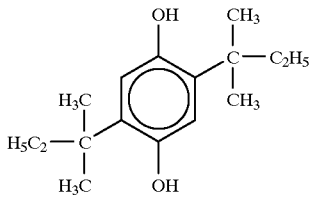
(II-22)
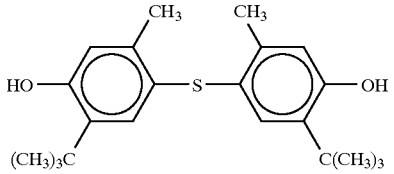

-continued
(II-23)
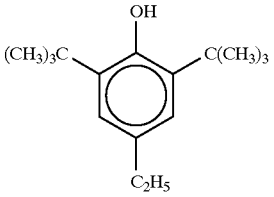
(II-24)
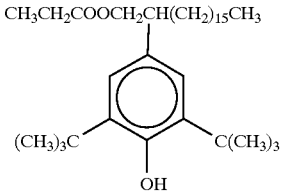
(II-25)
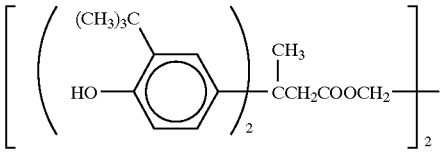
(III-1)
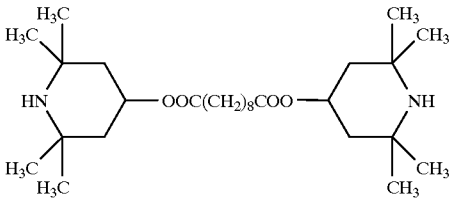
(III-2)
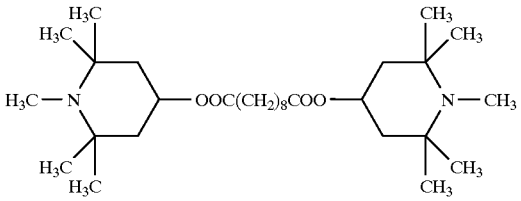
(III-3)
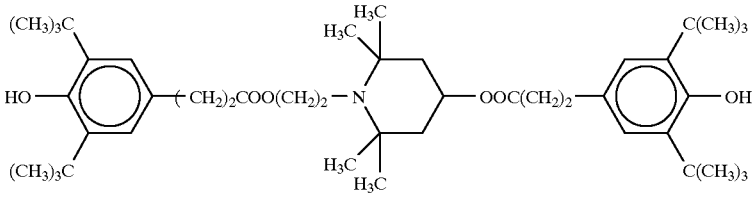
(III-4)
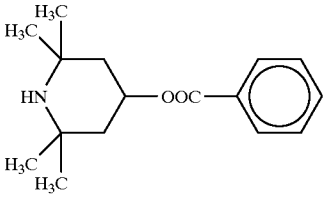

-continued
(III-5)
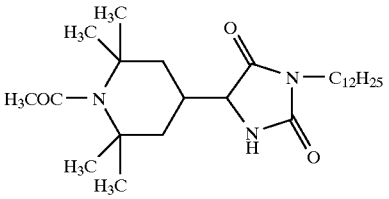
(III-6)
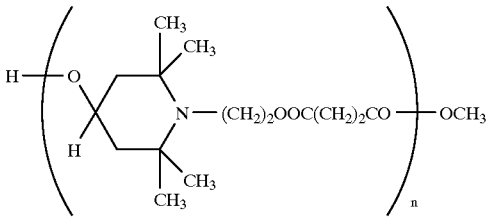
(III-7)
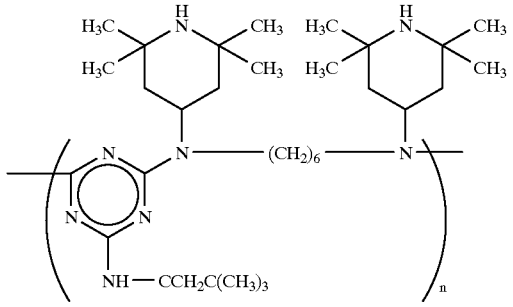
(III-8)
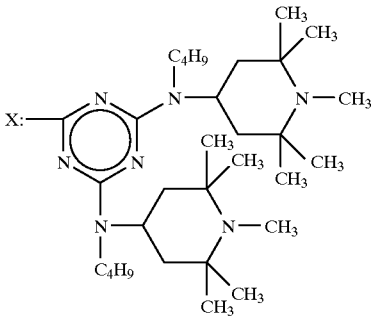

-continued (III-9)

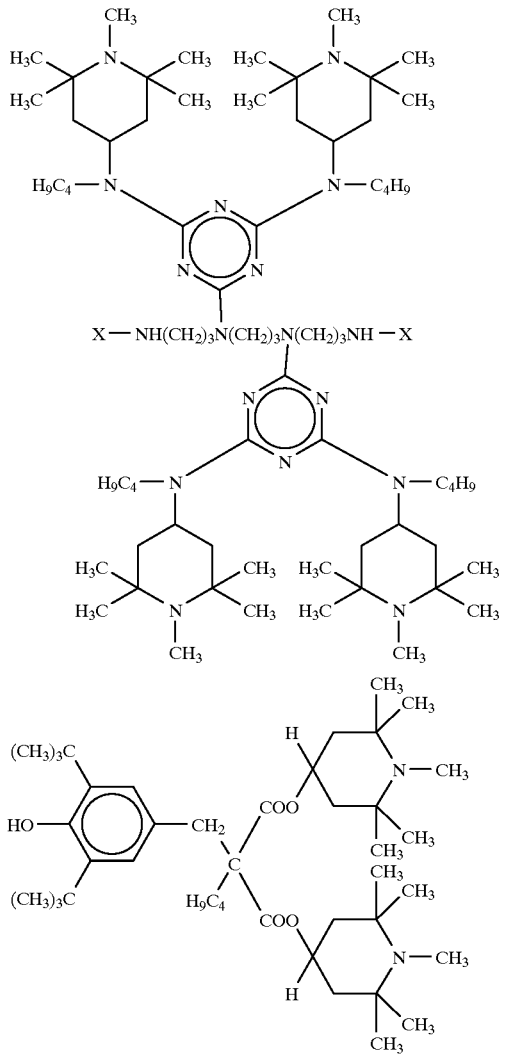

Preferably, the photosensitive layer further contains a polycarbonate resin in addition to the above mentioned charge transporting polymeric compound in the present invention. Particularly preferred is a polycarbonate resin represented by any of the following general formulae (A) to (G). The charge transporting polymeric material according to the present invention thereby have more charge transporting components in its structure as compared with conventional charge transporting layers comprising conventional charge transporting material/binder resin; therefore the resistance against discharge products is improved by adding a binder resin.

A

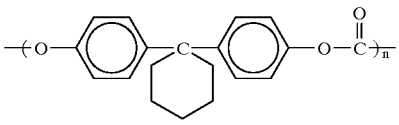

-continued

B

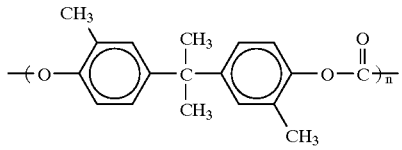

C

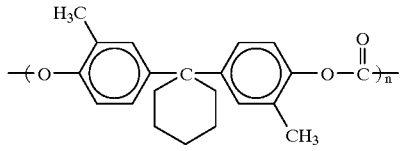

D

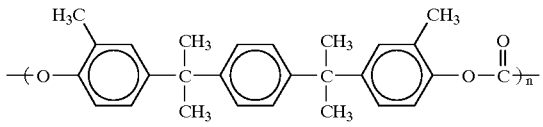

-continued

E

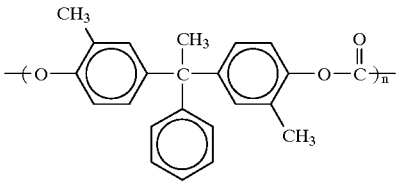

F

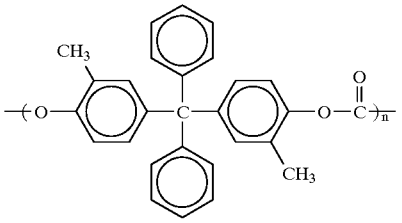

Now, the electrophotographic photosensitive material of the present invention will be further described with reference to the drawings.

Figure 2:
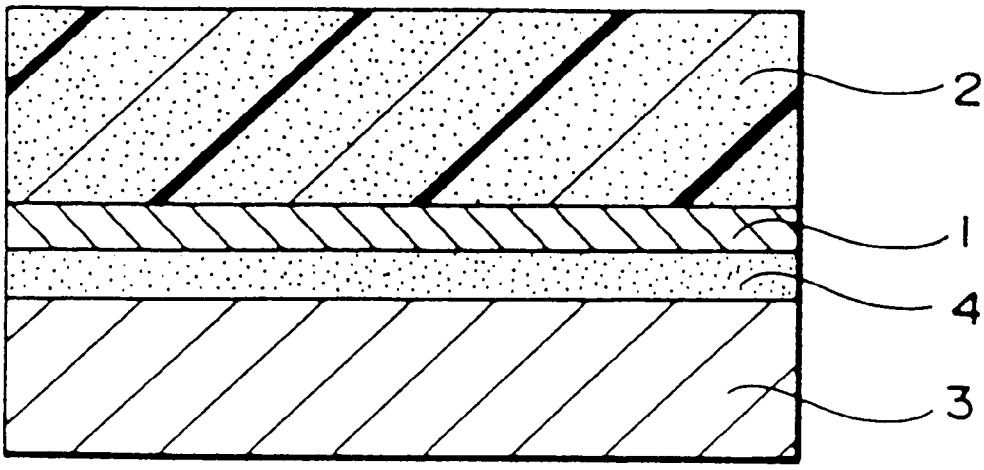
FIG. 2 is a schematic cross section of another example of the electrophotographic photosensitive material according to the present invention.
Figure 3:
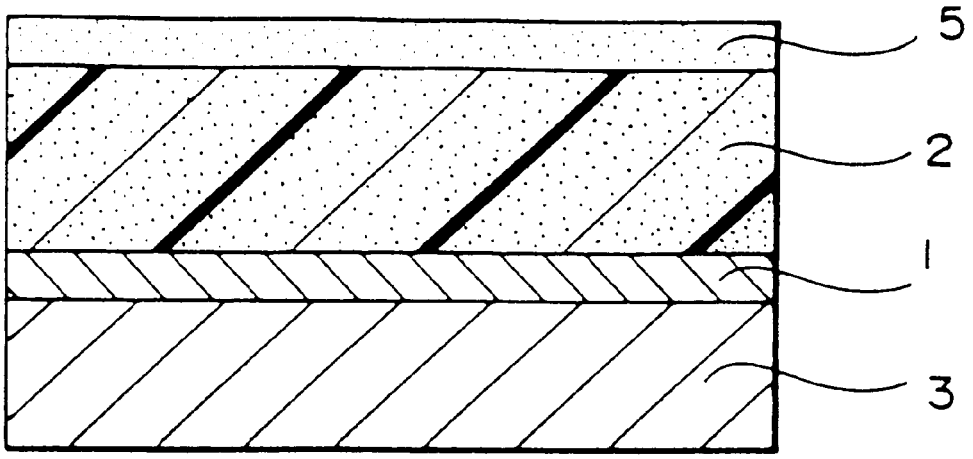
FIG. 3 is a schematic cross section of a still another example of the electrophotographic photosensitive material according to the present invention.
Figure 4:
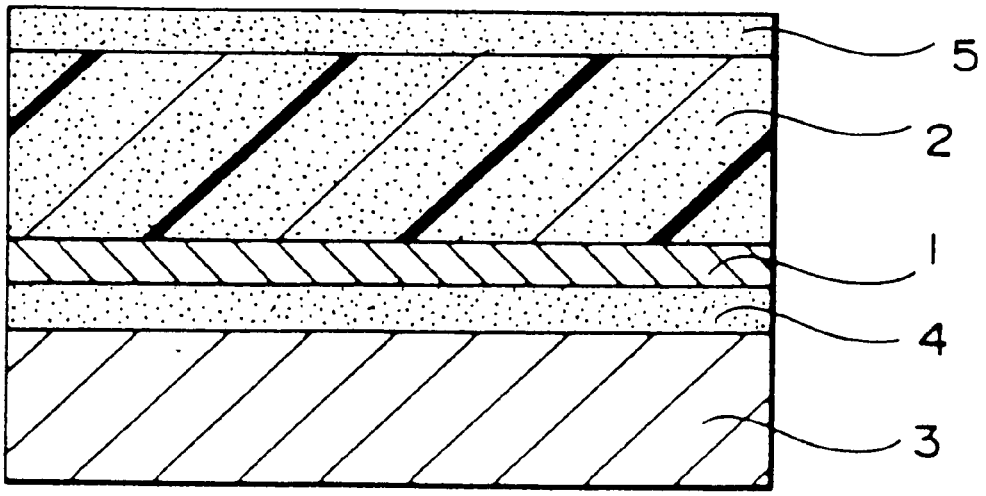
FIG. 4 is a schematic cross section of a still other example of the electrophotographic photosensitive material according to the present invention.
Figure 5:
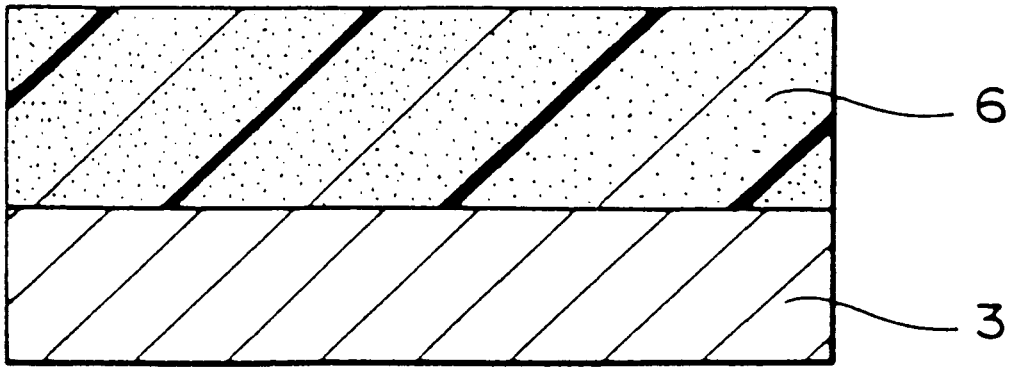
FIG. 5 is a schematic cross section of a further example of the electrophotographic photosensitive material according to the present invention.
Figure 6:
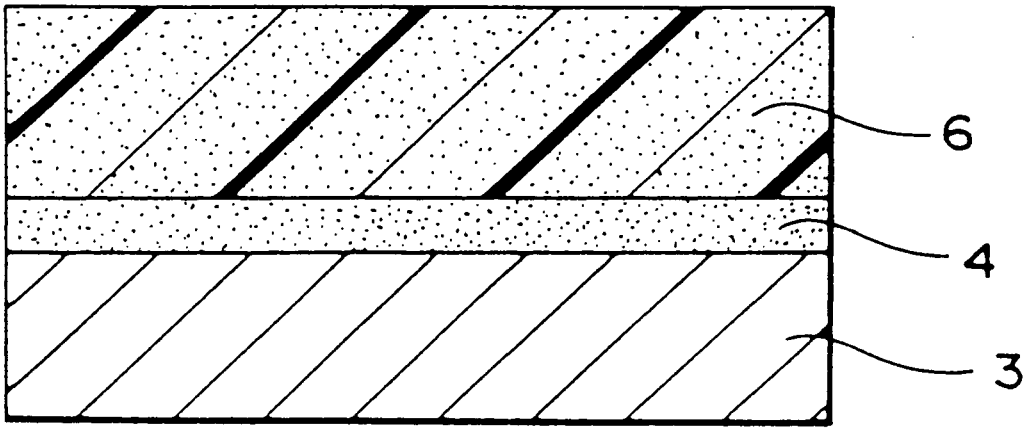
FIG. 6 is a schematic cross section of a still further example of the electrophotographic photosensitive material according to the present invention.

FIGS. 1 to 6 are schematic cross sections of examples of the electrophotographic photosensitive materials according to the present invention. FIG. 1 shows a photosensitive material in which a charge generating layer 1 and a charge transporting layer 2 are formed on a conductive support 3. FIG. 2 shows a photosensitive material having an undercoating layer 4 provided on the conductive support 3. FIG. 3 shows a photosensitive material having a protective layer 5 at the top. FIG. 4 shows a photosensitive material in which an undercoating layer 4 and a protective layer 5 are added onto the conductive support 3 and at the top, respectively, in the structure shown in FIG. 1. FIG. 5 shows a photosensitive material comprising a photoconductive layer 6 as a photosensitive layer formed on the conductive support 3. FIG. 6 shows a photosensitive material comprising an undercoating layer 4 provided on the conductive support 3. The photosensitive materials shown in FIGS. 1 to 4 have laminated photosensitive layers. Those shown in FIGS. 5 and 6 have a single photosensitive layer.

Examples of the electroconductive support 3 include metals, such is aluminum, nickel, chromium and stainless steel, plastic films coated with a thin layer of materials, such as aluminum, titanium, nickel, chromium, stainless steel, gold, vanadium, tin oxide, indium oxide and ITO, and a paper or plastic film coated with or impregnated with an electroconductivity imparting agent. The electroconductive support 3 may be used in an appropriate shape such as a drum, a sheet, a plate or the like, but is not limited to such shapes. In addition, if necessary, the surface of the electroconductive support 3 may receive a variety of treatments, in so far as these treatments do not impair the quality of image. For example, the treatments include the anodizing, hot water oxidizing treatment, chemical treatment, coloring treatment and irregular reflection creating treatment by means of the sanding of the surface.

In the photosensitive material for electrophotography of the present invention, the photosensitive layer, which is formed on the electroconductive support 3, may be a laminate structure comprising discrete functions divided into the electric charge generating layer 1 and the electric charge transporting layer 2 formed on the electroconductive support 3, as shown in FIGS. 1–4, or otherwise it may be the photoconductive layer 6 of a single-layer structure, as shown in FIGS. 5 and 6. The photosensitive layer comprises a coating film which contains an electric charge generating material or an electric charge transporting polymeric compound or both of them.

In the case where the photosensitive layer takes a laminate structure, any one of the electric charge generating layer 1 and the electric charge transporting layer 2 may be placed over the other. However, the explanation given below will center on the case where the electric charge transporting layer 2 forms the upper layer.

The electric charge generating layer 1 may be formed either by the vacuum deposition of an electric charge generating material or by applying a coating liquid which comprises an electric charge generating material dispersed in a binder resin in an organic solvent. The examples of the electric charge generating material used in the present invention include inorganic photoconductive materials, such as amorphous selenium, a crystalline selenium-tellurium alloy, a selenium-arsenic alloy, other selenium compounds and selenium-based alloys, granular selenium, zinc oxide and titanium oxide and organic pigments and dyes such as phthalocyanine, squalene, anthoanthrone, perylene, azo, anthraquinone, pyrene, pyrilium salts and thiapyrilium salts.

Of the above-mentioned examples, a photosensitive material which utilizes a phthalocyanine pigment, particularly metal-free phthalocyanine, titanyl phthalocyanine and gallium phthalocyanine has a high sensitivity in the range of near-infrared semiconductor laser wave (780–830 nm) and exhibits stable electrical properties over a long period of time.

Preferred examples of these phthalocyanine pigments include gallium phthalocyanine, which shows strong diffraction peaks at least at 6.8°, 12.8°, 15.8° and 26.0° at Bragg angle (2θ±0.2°) of X-ray diffraction spectrum obtained by using CuKα, hydroxygallium phthalocyanine, which shows strong diffraction peaks at least at 7.5°, 9.9°, 12.5°, 16.3°, 18.6°, 25.1°, and 28.3° at Bragg angle (2θ±0.2°) of X-ray diffraction spectrum by CuKα (see FIG. 7), and chloro-gallium phthalocyanine, which shows strong diffraction peaks at least at 7.4°, 16.6°, 25.5° and 28.3° at Bragg angle (2θ±0.2°) of X-ray diffraction spectrum by CuKα.

In the visible wave length range, the anthoanthrone pigment exhibits stable electrical properties over along period of time, while granular selenium, particularly granular, trigonal selenium, exhibits stable electrical properties and a high sensitivity over a long period of time.

Examples of the binder resin in the electric charge generating layer 1 include polyvinylbutyral resins, polyvinylformal resins, polyvlnylacetal resins such as partially acetalized polyvinylacetal resins, which have a part of butyral modified with formal, acetoacetal or the like, polyamide resins, polyester resins, modified ether-type polyester resins, polycarbonate resins, acrylic resins, polyvinyl chloride resins, polyvinylidene chloride resins, polystyrene resins, polyvinyl acetate resins, vinylchloride/vinylacetate copolymers, silicone resins, phenol resins, phenoxy resins, melamine resins, benzoguanamine resins, urea resins, polyurethane resins, poly-N-vinylcarbazole resins, polyvinyl anthrathene resins and polyvinylpyrene.

Of these resins, particularly, polyvinyl acetal resins, vinylchloride/vinylacetate copolymers, phenoxy resins and modified ether-type polyester resins are capable of satisfactorily dispersing the above-mentioned phthalocyanine pigments, anthoanthrone pigments and granular, trigonal selenium to prevent coagulation of pigments and to provide a coating liquid stable for a long period of time. Use of such coating liquid provides a uniform film, thus leading to better electrical properties and less defects of image. However, the resins to be used in the present invention are not limited to the above-mentioned resins, provided that the resins can form a coating film in an ordinary condition. These binder resins may be used alone or in combination of two or more of them.

The blending ratio of the electric charge generating material to the binder resin is preferably in the range of 5:1 to 1:2 by volume.

Examples of solvent to be used in preparing the coating liquid are conventional organic solvents such as methanol, ethanol, n-propanol, n-butanol, benzylalcohol, methylcellosolve, ethylcellosolve, acetone, methyl ethyl ketone, cyclohexanone, chlorobenzene, methyl acetate, n-butyl acetate, dioxane, tetrahydrofuran, methylene chloride and chloroform. These solvents may used alone or in combination of two or more of them.

The coating methods of the coating liquid are commonly used methods such as blade coating, Meyer bar coating, spraying, immersion coating, bead coating, air knife coating and curtain coating. Appropriate thickness of the electric charge generating layer 1 is in the range of 0.01–5 μm and preferably in the range of 0.1–2.0 μm. The uniform formation of the electric charge generating layer 1 becomes difficult if the thickness is less than 0.01 μm, while the properties of the electrophtography tend to be seriously impaired if the thickness exceeds 5 μm.

The preferable weight average molecular weight (Mw) of the electric charge transporting polymeric compound in the present invention is in the range of 5,000–750,000 and most preferably in the range of 50,000–500,000. In the case where the blend of the electric charge transporting polymeric compound and the aforementioned polycarbonate is used, the blending ratio (by weight) of the electric charge transporting polymeric compound to the aforementioned polycarbonate is preferably from 5:1 to 1:1.

For the preparation of the electric charge transporting layer 2 of the photosensitive material for the electrophtography of the present invention, preferably 0.01–10 parts, and more preferably 0.1–5 parts by weight of a compound having a hindered phenol structure or a hindered amine structure is used per 100 parts by weight of the charge transporting polymeric compound. The compound having a hindered phenol structure and the compound having a hindered amine structure may be used alone or in combination. The latter is preferable because of raising effects considerably.

In the layer 2, an antioxidant other than the above-mentioned compounds may be used which includes paraphenylene diamine, arylalkane, hydroquinone, spirochroman, spiroindanone, derivatives thereof, organosulfur compounds and organophosphorus compounds. A photostabilizer, such as a derivative of benzophenone, benzotriazole, dithiocarbamate and tetramethyl pyperidine, may be added to the electric charge transporting layer 2. In addition, for the purpose of increasing sensitivity, decreasing residual potential, decreasing fatigue due to repetitive use, etc., at least one electron acceptor material may be incorporated into the electric charge transporting layer 2. The examples of the electron acceptor material usable in the photosensitive material of the present invention include succinic anhydride, maleic anhydride, dibromomaleic anhydride, phthatic anhydride, tetrabromophthalic anhydride, tetracyano ethylene, tetracyanoquinodimethane, o-dinitrobenzene, m-dinitrobenzene, chloranyl, dinitroanthraquinone, trinitrofluorenone, picric acid, o-nitrobenzoic acid, p-nitrobenzoic acid and phthalic acid. Of these compounds, particularly preferred are fluorenone-, quinone-compounds, and benzene derivatives which have electron attracting substituents such as Cl, CN and $NO_2$.

In the present invention, for the main purpose of providing a good surface to the photosensitive layer, an additive may be incorporated into the uppermost layer of the photosensitive layer. The compound which is known as a modifier of paints can be used as the additive. Preferred examples include alkyl-modified silicone oils, such as dimethylsilicone oil, and an aromatic-modified silicone oils such as methylphenylsilicone oil. The adding amount of the additive is 1–10,000 ppm and preferably 5–2,000 ppm based on the solid of the electric charge transporting layer.

The examples of solvent to be used in preparing the electric charge transporting layer 2 are conventional organic solvents which include aromatic hydrocarbons, such as benzene, toluene and xylene, halogenated aromatic hydrocarbon, such as chlorobenzene, ketones, such as acetone and methyl ethyl ketone, halogenated aliphatic hydrocarbons, such as methylene chloride, chloroform and ethylene chloride, and cyclic or linear ethers, such as tetrahydrofuran and ethyl ether. These solvents may used alone or in combination of two or more of them.

The coating method of the layer 2 may be any conventional method such as blade coating, Meyer bar coating, spraying, immersion coating, bead coating, air knife coating and curtain coating.

The thickness of the electric charge transporting layer 2 of the present invention is generally in the range of 5–70 μm and preferably in the range of 10–50 μm. The potential of initial electrostatic charge tnds to drop if the thickness is less than 5 μm, while the properties of the electrophtography and quality of image tend to be impaired if the thickness exceeds 70 μm.

The electric charge transporting layer 2 can also be suitably used as a protective layer by providing it on an electric charge transporting layer that comprises a group of other compounds. The examples of the foregoing electric charge transporting layer include the aforementioned electric charge transporting polymeric compounds, a combination or the electric charge transporting polymeric compound and a polycarbonate resin, and a product made by dispersing a conventional, low molecular weight, electric charge transporting material in a binder resin.

In the case where the photosensitive layer of the electrophotographic photosensitive material of the present invention has a single-layer structure, an electric charge generating material, an electric charge transporting polymeric compound and a polycarbonate resin-containing compound may be the same as those in the case where the photosensitive layer has a laminate structure. Further, the photosensitive layer may contain any of the aforementioned additives, such as antioxidants, photostabilizers and surface smoothening agents, as necessary.

In the single-layer photosensitive material, the suitable proportion of the electric charge generating material to the electric charge transporting polymeric compound is 0.1–20% by weight and preferably 0.5–5% by weight.

A method for coating the electroconductive support 3 with a photosensitive single-layer comprises the steps of uniformly dispersing or dissolving the above-mentioned ingredients in a solvent, examples of which are shown for the case of preparing an electric charge transporting layer, applying the resulting liquid to the support according to the aforementioned conventional method and drying the film. The thickness of the single-layer photosensitive material is generally in the range of 5–70 μm and preferably in the range of 10–40 μm.

In the present invention, an underlayer 4 is preferably provided between the electroconductive support 3 and the photosensitive layer, as shown in FIGS. 2, 4 and 6. The functions of the underlayer 4 include a function as a binding layer bonding the photosensitive layer and the electroconductive support 3 to integrally hold both of them; a function of preventing the intrusion of the electric charge from the electroconductive support 3 to the photosensitive layer at the time when the photosensitive layer bears electric charge; and the prevention of the reflection of the light from the electroconductive support 3, depending on the case.

Examples of the binder resins to be used for the underlayer 4 include known materials such as polyamide resins, vinyl chloride resins, vinyl acetate resins, phenol resins, polyurethane resins, melamine resins, benzoguanamine resins, polyimide resins, polyethylene resins, polypropylene resins, polycarbonate resins, acrylic resins, methacrylic resins, vinylidene chloride resins, polyvinylacetal resins, vinylchloride/vinylacetate copolymers, polyvinyl alcohol resins, water-soluble polyester resins, nitrocellulose, casein, gelatin, polyglutamic acid, starch, starch acetate, amino starch, polyacrylic acid, polyacryl amide, zirconium chelate compounds, titanyl chelate compounds, titanyl alkoxide compounds, organotitanium compounds and the silane coupling agents. These materials may be used alone or in combination of two or more of them.

Further, the material may be blended with such finely divided particles as titanium oxide, aluminium oxide, silicon oxide, zirconium oxide, barium titanate and silicone resins.

The coating method for producing the underlayer 4 include conventional methods such as blade coating, Meyer bar coating, spraying, immersion coating, bead coating, air knife coating and curtain coating. The appropriate thickness of the underlayer 4 is in the range of 0.01–10 $\mu$m and preferably in the range of 0.05–2 $\mu$m.

In the photosensitive material for the electrophtography of the present invention, a protective layer 5 may be formed on the photosensitive layer, i.e., on the photosensitive layer in the case of a single-layer photosensitive material and on the electric charge transporting layer 2 in the case of a laminate photosensitive material as illustrated in FIGS. 3 and 4.

Conductive members for effecting contact charging or the electrophotographic photosensitive materials according to the present invention have any shape such as brush, blade, pin electrode or roller with roller members being preferred. Generally, a roller member comprises a core material, an elastic layer formed thereon, and an outermost (electrically) resistive layer supported thereby. If necessary, a protective layer may be provided on the resistive layer.

The core material is conductive and generally includes iron, copper, brass, stainless, aluminium and nickel. A shaped resin article in which conductive particles are dispersed may also be used.

The elastic layer is conductive or semi-conductive and generally is a rubber material in which conductive or semi-conductive particles are dispersed.

The rubber material includes EPDM, polybutadiene, natural rubber, polyisobutylene, SBR, CR, NBR, silicone rubber, urethane rubber, epichlorohydrin rubber, SBS, thermoplastic elastomer, norbornene rubber, fluorosilicone rubber and ethylene oxide rubber. The conductive or semi-conductive particles may include carbon black; metals such as zinc, aluminium, copper, iron, nickel, chromium and titanium; and metal oxides such as $ZnO$-$Al_2O_3$, $SnO_2$-$Sb_2O_3$, $In_2O_3$-$SnO_2$, $ZnO$-$TiO_2$, $MgO$-$Al_2O_3$, $FeO$-$TiO_2$, $TiO_2$, $SnO_2$, $Sb_2O_3$, $In_2O_3$, $ZnO$ and $MgO$. These materials may be used alone or as a mixture of two or more thereof. When two or more materials are used, one may be finely divided particles which may be fluororesin.

The materials for the resistive layer and the outer protective layer may be a binder resin in which conductive or semi-conductive particles are dispersed to control the resistivity. The resistivity may be $10^3$ to $10^{14}$ Ωcm, preferably $10^5$ to $10^{12}$ Ωcm, more preferably $10^7$ to $10^{12}$ Ωcm. The thickness thereof may be 0.01 to 1,000 $\mu$m, preferably 0.1 to 500 $\mu$m, more preferably 0.5 to 100 $\mu$m.

The binder resin may include acrylic resin, cellulose resin, polyamide resin, methoxymethylated nylon, ethoxymethylated nylon, polyurethane resin, polycarbonate resin, polyester resin, polyethylene resin, polyvinyl resin, polyarylate resin, polythiophene resin, polyolefin resins such as PFA, FEP and PET, and styrene-butadiene resin.

The conductive or semi-conductive particles may be such carbon black, metal or metal oxide as in the elastic layer. The resistive and outer protective layers may optionally contain an antioxidant such as hindered phenol or amine, a filler such as clay or kaoline, a lubricant such as silicone oil. These layers may be formed by any means such as blade coating, Mayer bar coating, spray coating, dip coating, bead coating, air knife coating, curtain coating, vacuum deposition and plasma coating.

When the conductive member is used to charge the photosensitive material, a voltage is applied to the conductive member. The applied voltage is preferably a direct current voltage superimposed on an alternating current voltage. It is difficult to provide uniform charging with a direct current voltage only.

The direct current voltage preferably ranges from + or −50 to 2,000 V, particularly 100 to 1,500 V. The alternating current voltage superimposed thereon ranges 400 to 1,800 V, preferably 800 to 1,600 V, more preferably 1,200 to 1,600 V in terms of the voltage between peaks. If this voltage between peaks exceeds 1,800 V, the resulting charging will be less uniform than the case where no alternating current voltage is superimposed. The alternating current voltage preferably has a frequency of 100 to 2,000 Hz.

EXAMPLES

The present invention will be further illustrated by the following examples.

Example 1

A solution consisting of 10 parts of a zirconium compound (tradename: ORGATICS ZC540 manufactured by MATSUMOTO SEIYAKU), 1 part of a silane compound (tradename: A1110 manufactured by NIPPON UNICAR), 40 parts of i-propanol and 20 parts or butanol was applied onto a drum-like aluminium substrate by dipping and dried at 150° C. for 10 minutes to form an undercoating layer of 0.1 $\mu$m in coating thickness.

Figure 7:
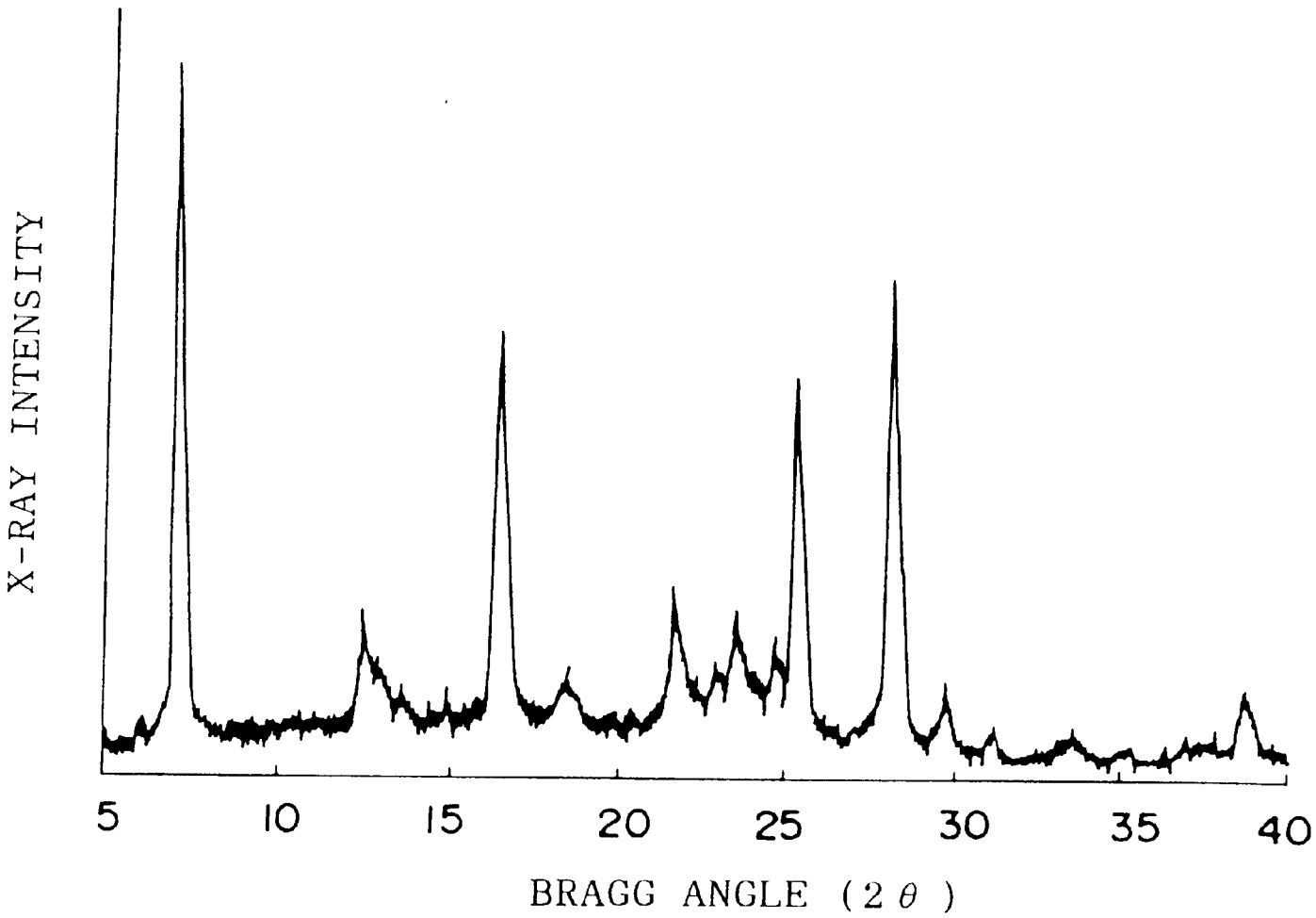
FIG. 7 is a powder X-ray diffraction spectrum (with use of Cu Ka) of hydroxygallium phthalocyanine used in Examples.

Then, a mixture comprising 1 part of hydroxygallium phthalocyanine having the X-ray diffraction spectrum as shown in FIG. 7 as a charge generating material, 1 part of a carboxyl modified vinyl chloride-vinyl acetate copolymer (tradename: VMCH manufactured by Union Carbide) and 100 parts of chlorobenzene was dispersed together with glass beads in a sand mill for 1 hour. The resulting coating liquid was applied on the undercoating layer by dipping and dried at 100° C. for 10 minutes to form a charge generating layer of 0.25 $\mu$m in film coating thickness.

Then, 20 parts of the Compound No. 91 (weight average molecular weight: 87,000) as a charge transporting polymeric compound and 0.5 parts of the Compound II-1 as a hindered phenol compound were dissolved in a mixture of 60 parts of monochlorobenzene and 30 parts of tetrahydrofuran. The resulting coating liquid was applied onto the charge generating layer and dried at 115° C. for 60 minutes to form a charge transporting layer of about 20 μm in coating thickness.

Thus, a photosensitive layer was formed on the drum-like aluminium substrate.

Then, a conductive roller of 12 mm in diameter was formed using a stainless rod of 6 mm in diameter as a core material, a conductive EPDM rubber of $10^6$ Ωcm in resistivity as an elastic layer and an epichlorohydrin rubber of $10^9$ Ωcm in resistivity as a resistive layer.

The resulting photosensitive material and conductive roller were mounted in a text device (XP-15, modified, manufactured by Fuji Xerox) in which a surface potentiometer (manufactured by Trek) was provided at a developing device of a laser beam printer. A direct current voltage −600 V and an alternating current voltage 1,500 V (voltage between peaks, frequency: 1 kHz) were applied to the conductive roller (contact charging) and an initial image quality was estimated. After repeating 100,000 printing, image qualities were estimated and the amount of wear on the outermost surface was measured. The results are shown in Table 11.

Further, other photosensitive materials prepared as above were mounted in a similar test device which was modified from a conventional laser beam printer (XP-15 manufactured by Fuji Xerox) having a charging means (non-contact charging) at SCOROTRON and similar estimation was done. The results are shown in Table 12.

Reference Example 1

An electrophotographic photosensitive material was prepared and a similar test was conducted as in Example 1 except that the Compound II-1 used in Example 1 was not used. The results are shown in Tables 11 and 12.

Comparative Example 1 (Known Example)

An electrophotographic photosensitive material was prepared and a similar test was conducted as in Example 1 except that as a charge transporting material, 8 parts by weight of a benzidine compound represented by the following structural formula instead of the charge transporting polymeric compound No. 91 used in the charge transporting layer of Example 1, 12 parts by weight of a polycarbonate resin C (viscosity average molecular weight: 45,000) as a binder resin and 0.5 parts of the Compound II-1 as a hindered phenol compound were dissolved in 80 parts of monochlorobenzene and the resulting coating liquid was used to form a low molecular weight dispersed charge transporting layer. The results are shown in Tables 11 and 12.

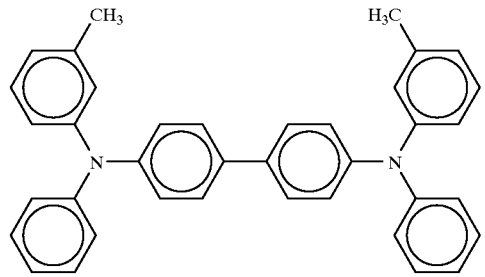

Example 3

An electrophotographic photosensitive material was prepared and a similar test was conducted as in Example 1 except that 0.5 parts of the Compound III-3 as a hindered amine compound was added in addition to the Compound II-1 used in Example 1. The results are shown in Tables 11 and 12.

Example 4

An electrophotographic photosensitive material was prepared and a similar test was conducted as in Example 1 except that the Compound No. 126 (weight average molecular weight: 89,000) was used as a charge transporting polymeric compound instead of the Compound No. 91 used in Example 1 and the Compound II-1 was substituted by 1.0 part of the Compound II-7 as a hindered phenol compound. The results are shown in Tables 11 and 12.

Reference Example 2

An electrophotographic photosensitive material was prepared and a similar test was conducted as in Example 4 except that the Compound II-7 used in Example 4 was not used. The results are shown in Tables 11 and 12.

Example 5

An electrophotographic photosensitive material was prepared and a similar test was conducted as in Example 4 except that the Compound II-7 used in Example 1 was substituted by 2.0 parts of the Compound II-17 as a hindered phenol compound. The results are shown in Tables 11 and 12.

Example 6

An electrophotographic photosensitive material was prepared and a similar test was conducted as in Example 1 except that 0.5 parts of the Compound III-2 as a hindered phenol compound was added in addition to the Compound II-7 used in Example 1. The results are shown in Tables 11 and 12.

Example 7

An electrophotographic photosensitive material was prepared and a similar test was conducted as in Example 1 except that 20 parts of the Compound No. 91 (weight average molecular weight: 87,000) used in the charge transporting layer of Example 1 was substituted by 15 parts of the Compound No. 91 (weight average molecular weight: 87,000) and 5 parts of a polycarbonate resin C (viscosity average molecular weight: 45,000). The results are shown in Tables 11 and 12.

TABLE 11

| | Image Quality After 100,00 Printing | Amount of Wear (μm) |
|---|---|---|
| Ex. 1 | No Problem | 4.7 |
| Ref. Ex. 1 | Insufficient concentration and image blurring after 65,000 printing | 4.5 |
| Comp. Ex. 1 | Defective wear wounds after 20,000 printing | 14.1 |
| Ex. 3 | No problem | 5.0 |
| Ex. 4 | No problem | 3.8 |
| Ref. Ex. 2 | Insufficient concentration and image blurring after 70,000 printing | 3.5 |
| Ex. 5 | No problem | 4.0 |
| Ex. 6 | No problem | 4.1 |
| Ex. 7 | No problem | 6.2 |

TABLE 12

| | Image Quality After 100,00 Printing | Amount of Wear (μm) |
|---|---|---|
| Ex. 1 | No Problem | 3.6 |
| Ref. Ex. 1 | Insufficient concentration and image blurring after 80,000 printing | 3.6 |
| Comp. Ex. 1 | Defective wear wounds after 25,000 printing | 12.1 |
| Ex. 3 | No problem | 4.0 |
| Ex. 4 | No problem | 3.2 |
| Ref. Ex. 2 | Insufficient concentration and image blurring after 75,000 printing | 3.0 |
| Ex. 5 | No problem | 3.1 |
| Ex. 6 | No problem | 3.2 |
| Ex. 7 | No problem | 5.3 |

As seen from the above comparison, the electrophotographic photosensitive materials according to the present invention maintain excellent repeating image stability and have high wear resistance in both contact and non-contact charging modes.

According to the electrophotographic photosensitive material of the present invention, wherein the photosensitive layer contains a charge transporting polymeric compound having at least one structure represented by the general formula (I-1) or (I-2) as a partial structure of the repeating unit and said photosensitive layer further contains at least one of specific hindered phenol or amine compounds, the wear resistance, corona discharge resistance and toner filming resistance are high. When the photosensitve material is repeatedly used for a long period of time in a copying machine or printer, no problem occurs in the photosensitive layer and the electrophotographic properties do not be reduced. Thus, the electrophotographic photosensitive material of the present invention has a sufficient durability to provide copies with excellent image quality for a long period of time.

What is claimed is:

1. An electrophotographic photosensitive material having a photosensitive layer on a conductive support, said photosensitive layer comprising at least one charge transport polymeric compound selected from the group consisting of the following formulae (IV) to (VI):

(IV)

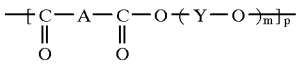

-continued (V)

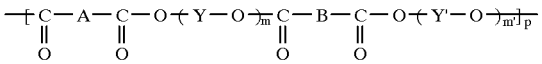

(VI)

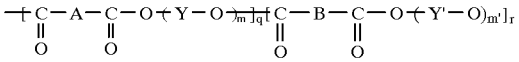

wherein A represents a structure represented by the following general formula (I-2) as a partial structure of a repeating unit:

(I-2)

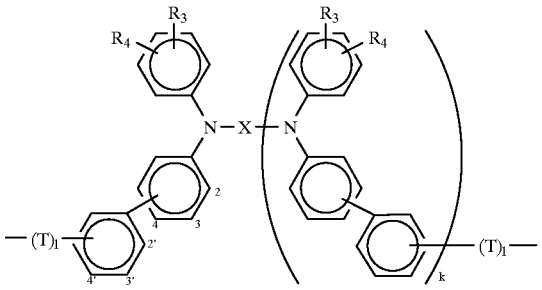

wherein $R_3$ to $R_4$ each independently represents a hydrogen atom, an alkyl group, an alkoxy group, a substituted amino group, a halogen atom or a substituted or unsubstituted aryl group, X represents a substituted or unsubstituted divalent aryl group, k and l each independently represents an integer selected from 0 and 1, T represents an optionally branched, divalent hydrocarbon group having 1 to 10 carbon atoms, Y, Y' and B represent divalent hydrocarbon groups, m and m' each represents an integer of 1 to 5, p represents an integer of 5 to 5,000, q represents an integer of 5 to 5,000, r represents an integer of 1 to 3,500, q+r is an integer of 5 to 5,000, and $1>q/(q+r)\geqq 0.3$, and said photosensitive layer further comprising at least one compound having a hindered phenol structural unit, which has compatibility with said charge transport polymeric compound, represented by the following general formula (II) or a hindered amine structural unit, which has compatibility with said charge transport polymeric compound, represented by the following general formula (III):

(II)

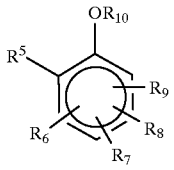

-continued (III)

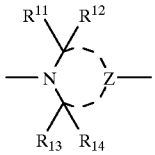

wherein $R_5$ represents a branched alkyl, $R_6$ to $R_8$ each independently represents a hydrogen atom, a hydroxy group, an alkyl group or an aryl group, at least two of $R_6$, $R_7$ and $R_8$ may be linked to one another to form a ring, $R_9$ represents a hydrogen atom or an alkyl group, $R_{10}$ to $R_{14}$ each independently represents a hydrogen atom, an alkyl group or an aryl group, Z represents an atomic group required to constitute a nitrogen atom containing ring, and in each combination of $R_{11}$ and $R_{12}$ or $R_{13}$ and $R_{14}$ one of them may be incorporated into Z to provide a double bond, or wherein one or more of $R_5$ to $R_9$ is an aralkyl group, with the remaining groups of $R_5$ to $R_9$ being hydrogen atoms, and $R_{10}$ to $R_{14}$ and Z are as defined above.

2. The electrophotographic photosensitive material of claim 1, wherein said photosensitive layer comprises said charge transporting polymeric compound and a polycarbonate resin having at least one repeating unit structure selected from the group consisting of the following general formulae (A) to (F):

A

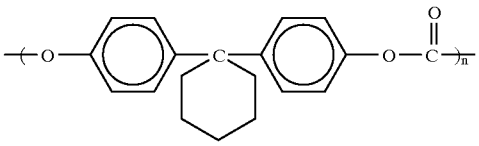

B

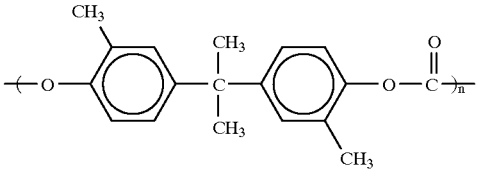

C

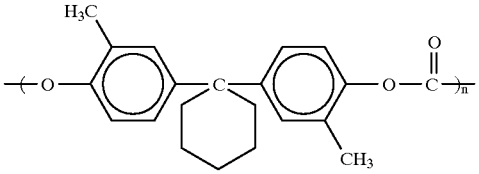

D

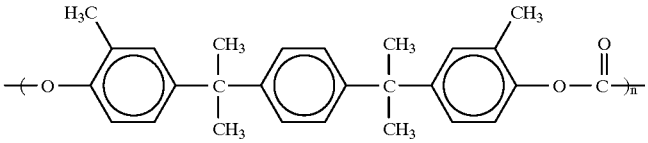

E

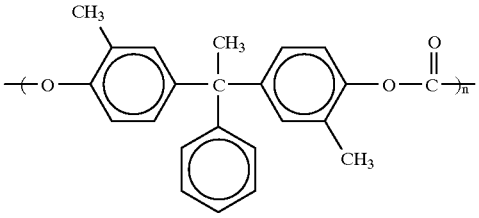

-continued

F

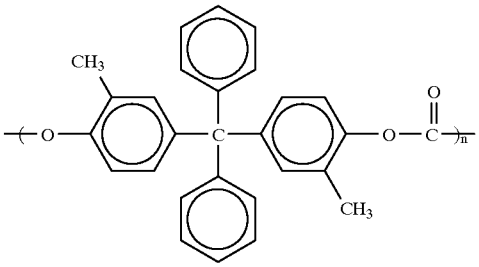

wherein n has a value so that the resin has a viscosity average molecular weight of 20,000 to 100,000.

3. The electrophotographic photosensitive material of claim 2, wherein an outermost surface layer of said photosensitive layer comprises the charge transporting polymeric compound represented by at least one compound selected from the group consisting of said structural formulae (IV) to (VI); the compound having a hindered phenol structural unit represented by said general formula (II) or the compound having a hindered amine structural unit represented by said general formula (III); and the polycarbonate resin represented by at least one formula selected from the group consisting of said general formulae (A) to (F).

4. The electrophotographic photosensitive material of claim 2, wherein said photosensitive layer comprises sequentially laminated charge generating and charge transporting layers, and said charge transporting layer contains the charge transporting polymeric compound represented by at least one compound selected from the group consisting of said structural formulae (IV) to (VI); the compound having a hindered phenol structural unit represented by said general formula (II) or the compound having a hindered amine structural unit represented by said general formula (III); and the polycarbonate resin represented by at least one formula selected from the group consisting of said general formulae (A) to (F).

5. The electrophotographic photosensitive material of claim 1, wherein an outermost surface layer of said photosensitive layer comprises the charge transporting polymeric compound represented by at least one compound selected from the group consisting of said structural formulae (IV) to (VI); and the compound having a hindered phenol structural unit represented by said general formula (II) or the compound having a hindered amine structural unit represented by said general formula (III).

6. The electrophotographic photosensitive material of claim 1, wherein said photosensitive layer has a single layer structure.

7. The electrophotographic photosensitive material of claim 1, wherein said photosensitive layer comprises sequentially laminated charge generating and charge transporting layers, and said charge transporting layer contains the charge transporting polymeric compound represented by at least one compound selected from the group consisting of said structural formulae (IV) to (VI); and the compound having a hindered phenol structural unit represented by said general formula (II) or the compound having a hindered amine structural unit represented by said general formula (III).

8. The electrophotographic photosensitive material of claim 1, wherein an undercoating layer is provided between the conductive support and said photosensitive layer.

9. The electrophotographic photosensitive material of claim 1, wherein the photosensitive material comprises at least one compound having a hindered phenol structural unit represented by said general formula (II).

10. The electrophotographic photosensitive material of claim 1, wherein the photosensitive material comprises at least one compound having a hindered amine structural unit represented by said general formula (III).

11. The electrophotographic photosensitive material of claim 1, wherein the photosensitive material comprises a phthalocyanine pigment as a charge generating material.

12. The electrophotographic photosensitive material of claim 1, wherein the photosensitive material comprises a anthoanthrone pigment or granular selenium as a charge generating material.

13. The electrophotographic photosensitive material of claim 1, wherein the charge transporting polymeric compound has a weight average molecular weight from 5,000–750,000.

14. The electrophotographic photosensitive material of claim 1, wherein the compound having a hindered phenol structural unit represented by said general formula (II) and/or the compound having a hindered amine structural unit represented by said general formula (III) are/is used in a total amount of 0.01–10 parts by weight with respect to 100 parts by weight of the charge transporting polymeric compound.

15. An electrophotographic photosensitive material of claim 1, wherein in said hindered phenol compound represented by the general formula (II) $R_5$ is a tert- or sec-alkyl group having 3 to 40 carbon atoms and in said hindered amine compound represented by the general formula (III) an alkyl group having one to eight carbon atoms is attached to each of ortho positions to the nitrogen atom.

16. The electrophotographic photosensitive material of claim 15, wherein the tert- or sec-alkyl group in said hindered phenol compound has 3 to 5 carbon atoms.

17. The electrophotographic photosensitive material of claim 15, wherein the alkyl group of the cyclic hindered amine compound is methyl.

18. The electrophotographic photosensitive material of claim 15, further comprising a polycarbonate resin having at least one repeating unit structure selected from the group consisting of the following general formulae (A) to (F):

A

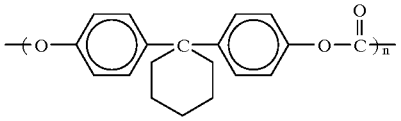

-continued

B

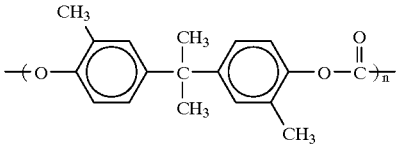

C

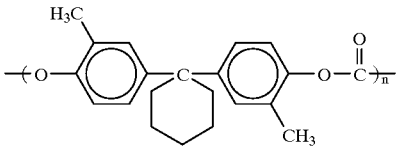

D

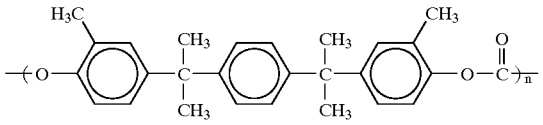

E

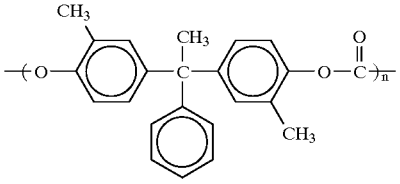

F

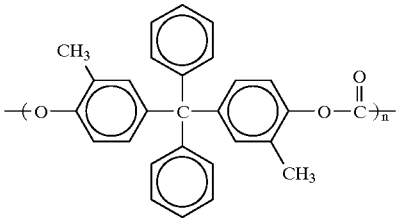

wherein n has a value so that the resin has a viscosity average molecular weight of 20,000 to 100,000.

19. The electrophotographic photosensitive material of claim 1, wherein said photosensitive layer comprises at least one compound having a hindered phenol structural unit represented by formula (II) and a hindered amine structural unit represented by formula (III).

20. An electrophotographic photosensitive material having a photosensitive layer on a conductive support, said photosensitive layer comprising a compound represented by at least one group consisting of the following formulae (IV) to (VI) as a charge transporting polymeric compound:

(IV)

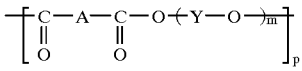

(V)

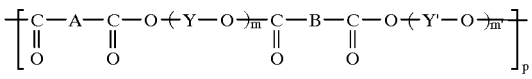

-continued (VI)

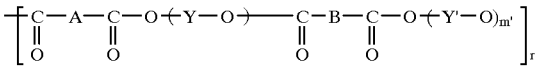

wherein A represents a structure represented by the following general formula (I-2) as a partial structure of a repeating unit:

(I-2)

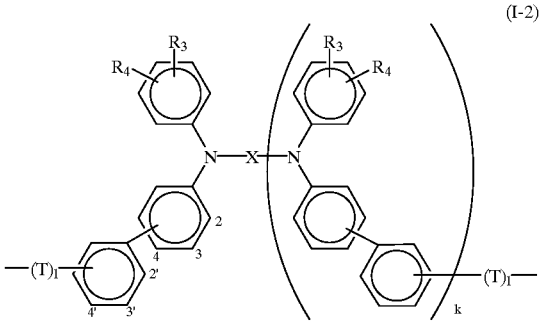

wherein $R_3$ to $R_4$ each independently represents a hydrogen atom, an alkyl group, an alkoxy group, a substituted amino group, a halogen atom or a substituted or unsubstituted aryl group, X represents a substituted or unsubstituted divalent aryl group, k and l each independently represents an integer selected from 0 and 1, T represents an optionally branched, divalent hydrocarbon group having 1 to 10 carbon atoms, B represents a divalent hydrocarbon group, m and m' each represents an integer of 1 to 5, p represents an integer of 5 to 5,000, q represents an integer of 5 to 5,000, r represents an integer of 1 to 3,500, q+r is an integer of 5 to 5,000, and $1>q/(q+r)\geqq 0.3$, and wherein Y and Y' are selected from the group consisting of the following formulae (19) to (25):

(19)

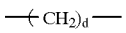

(20)

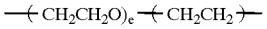

(21)

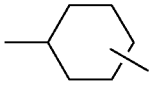

(22)

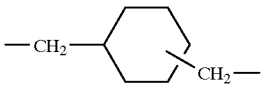

(23)

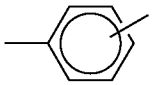

(24)

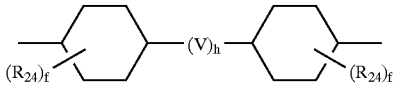

-continued (25)

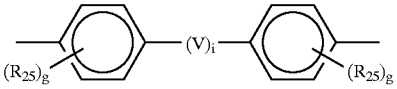

wherein $R_{24}$ and $R_{25}$ each independently represents a hydrogen atom, an alkyl group having 1 to 4 carbon atoms, an alkoxy group having 1 to 4 carbon atoms, a substituted or unsubstituted phenyl, a substituted or unsubstituted aralkyl group or a halogen atom, d and e represent integers of 1 to 10, f and g represent integers of 0, 1 or 2, h and i represent 0 or 1, and V is selected from the group consisting of the following groups (9) to (18):

(9)

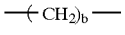

(10)

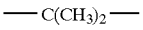

(11)

(12)

(13)

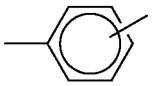

(14)

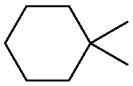

(15)

(16)

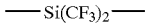

(17)

-continued (18)

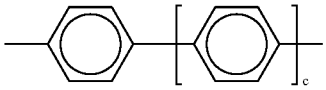

wherein b represents an integer of 1 to 10 and c represents an integer of 1 to 4, and said photosensitive layer further comprising a hindered phenol compound represented by formula (II) or a cyclic hindered amine compound represented by formula (III):

(II)

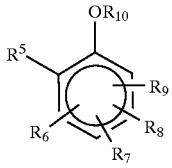

(III)

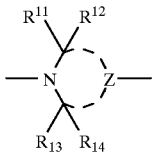

wherein $R_5$ represents a tert- or sec-alkyl group having 3 to 40 carbon atoms, $R_6$ to $R_8$ each independently represents a hydrogen atom, a hydroxy group, an alkyl group or an aryl group, at least two of $R_6$, $R_7$ and $R_8$ may be linked to one another to form a ring, $R_9$ represents a hydrogen atom or an alkyl group, $R_{10}$ represents a hydrogen atom, an alkyl group or an aryl group, $R_{11}$ to $R_{14}$ each independently represents an alkyl group having one to eight carbon atoms, and Z represents an atomic group required to constitute a nitrogen atom containing ring.

* * * * *